US007354148B2

(12) United States Patent
Oishi

(10) Patent No.: US 7,354,148 B2
(45) Date of Patent: Apr. 8, 2008

(54) INKJET PRINTER

(75) Inventor: Tatsuo Oishi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 295 days.

(21) Appl. No.: 11/011,554

(22) Filed: Dec. 15, 2004

(65) Prior Publication Data

US 2005/0151772 A1 Jul. 14, 2005

(30) Foreign Application Priority Data

Dec. 15, 2003 (JP) ..... 2003-415858

(51) Int. Cl.
*B41J 2/01* (2006.01)

(52) U.S. Cl. ..... 347/104; 347/16; 347/19

(58) Field of Classification Search ..... 347/16, 347/5, 19, 9, 101, 104, 105
See application file for complete search history.

(56) References Cited

U.S. PATENT DOCUMENTS 6,935,738 B2 * 8/2005 Lorenz et al. ..... 347/104
6,938,969 B2 * 9/2005 Shibasaki ..... 347/12

FOREIGN PATENT DOCUMENTS

JP A 5-162303 6/1993
JP A 11-291513 10/1999
JP A 2003-103773 4/2003

* cited by examiner

*Primary Examiner*—Lam Son Nguyen
(74) *Attorney, Agent, or Firm*—Oliff & Berridge, PLC

(57) ABSTRACT

An inkjet printer includes an inkjet head, a sheet supply unit and a sheet supply position switching unit. The sheet supply unit has two sheet trays corresponding to two printing positions of the inkjet head which are shifted from each other in the width direction of the sheet. The sheet supply unit is capable of selectively supplying a sheet narrower than the maximum printable width of the inkjet head from either one of trays to the inkjet head. The sheet supply position switching unit switches one of the sheet trays to the other based on the number of printings on the narrower sheet at each of the printing positions.

21 Claims, 22 Drawing Sheets

INKJET PRINTER

BACKGROUND OF THE INVENTION

1. Field of the Invention

The present invention relates to an inkjet printer capable of ejecting ink onto a recording medium to perform a printing operation.

2. Description of the Related Art

An inkjet printer well known in the art includes a sheet supply mechanism for supplying sheet to a prescribed printing area opposed to an inkjet head and performs a printing operation on the sheet at this printing area by ejecting ink through a plurality of nozzles onto the sheet. Of these inkjet printers, both serial type and line type inkjet printers are well known in the art. Line type inkjet printers include an inkjet head whose longitudinal dimension corresponds to the maximum width of sheet that can be printed (hereinafter referred to as the "maximum printable width"). The inkjet head prints on the sheet as the sheet is fed, in a direction orthogonal to the longitudinal direction of the head. However, when sheet having a narrower width than the maximum printable width of the inkjet head is printed, the sheet is printed with only specific nozzles corresponding to the printing area of the narrow sheet among all nozzles of the inkjet head, so that these nozzles will eject ink an extraordinarily high number of times. In other words, a specific region of actuator units that eject ink through the nozzles will be used very frequently at this local position. Hence, this specific region of actuator units will degrade more quickly than the rest, causing a decline in ink ejection accuracy from nozzles at this printing area and resulting in an overall decline in printing quality.

Therefore, inkjet printers capable of preventing a concentrated use of specific nozzles have been proposed. For example, an inkjet printer disclosed in Japanese unexamined patent application publication No. 5-162303 is configured to offset nozzles in the widthwise direction for each sheet supplied to a prescribed printing area when contour lines extending in a sheet supply direction are printed, as in CAD drawings (see FIG. 3). This type of inkjet printer can somewhat alleviate the high increase in usage frequency of nozzles printing contour lines.

The inkjet printer disclosed in Japanese unexamined patent application publication No. 5-162303 offsets the printing of nozzles in the widthwise direction of the sheet. However, since the position in which the sheet is supplied from the sheet supplying mechanism does not change, the position of images printed on the sheet is different for each sheet. Further, there is a limit on how far the nozzles can be offset in the widthwise direction in order to keep the printed images within the sheet. Accordingly, the usage of nozzles in a specific area of the printing head increases dramatically in frequency when printing is made within a relatively wide range of sheet having a narrower width than the maximum printable width of the inkjet head. Thus, the local ejection accuracy of ink in this area is reduced. Hence, later printing on wider sheet will give rise to a local area with inferior printing quality. Further, when narrow sheet is printed continuously, components constituting the sheet conveying mechanism, such as sheet conveying rollers and belts, will be used much more frequently in areas used for supplying the narrow sheet, thereby necessitating the early replacement of these parts.

SUMMARY OF THE INVENTION

In view of the foregoing, it is an object of the present invention to provide an inkjet printer capable of preventing local deterioration of the inkjet head and sheet supply mechanism that are involved in the printing operation.

The present invention provides an inkjet printer, including: an inkjet head, a sheet supply unit, and a controller. The inkjet head prints on a sheet. The inkjet head has a maximum printable length in a width direction crossing a feeding direction of the sheet. The inkjet head has a plurality of printing portions, each of the plurality of printing portions having a width less than the maximum printable length. The plurality of printing portions is shifted from each other in the width direction. The sheet supply unit selectively feeds a narrow sheet having a width less than the maximum printable length to one of the plurality of printing portions. The controller switches the one of the plurality of printing portions to another of the plurality of printing portions based on the number of printings on the narrow sheet at each of the plurality of printing portions.

The present invention provides an inkjet printer, including: an inkjet head, a sheet supply unit, and a controller. The inkjet head prints on a sheet. The inkjet head has a maximum printable length in a width direction crossing a feeding direction of the sheet. The inkjet head has a plurality of printing portions, each of the plurality of printing portions having a width less than the maximum printable length. The plurality of printing portions is shifted from each other in the width direction. The sheet supply unit has a plurality of sheet supply portions. The plurality of sheet supply portions corresponding to the plurality of printing portions, respectively. The sheet supply unit feeds a narrow sheet from one of the plurality of sheet supply portions to corresponding one of the plurality of printing portions. The narrow sheet has a width less than the maximum printable length. The controller switches the one of the plurality of sheet supply portions to another of the plurality of sheet supply portions based on the number of printings on the narrow sheet at each of the plurality of printing portions.

The present invention provides an inkjet printer including: an inkjet head, a sheet supply unit, and a notice signal generating unit. The inkjet head prints on a sheet. The inkjet head has a plurality of printing portions. The plurality of printing portions is shifted from each other in a width direction crossing a feeding direction of the sheet. The sheet supply unit has a plurality of sheet supply portions corresponding to the, plurality of printing portions, respectively. The sheet supply unit selectively feeds a narrow sheet from one of the plurality of sheet supply portions to corresponding one of the plurality of printing portions. The notice signal generating unit generates a notice signal based on the number of printings at each of the plurality of printing portions. The notice signal indicates that the one of the plurality of sheet supply portions should be switched to another of the plurality of sheet supply portions.

BRIEF DESCRIPTION OF THE DRAWINGS

The above and other objects, features, and advantages of the invention will become more apparent from reading the following description of the preferred embodiments taken in connection with the accompanying drawings in which:

FIG. 8(*b*) is a plan view of an electrode;

DESCRIPTION OF THE PREFERRED EMBODIMENTS

Figure 1:
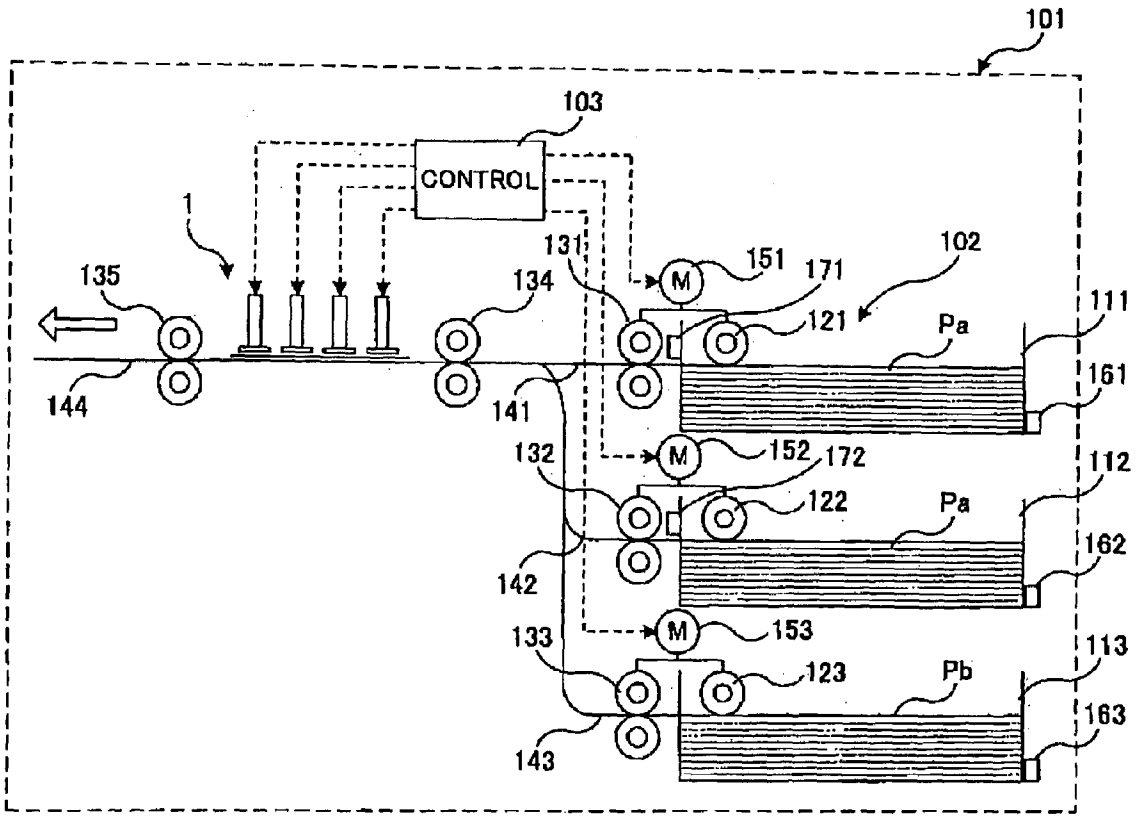
FIG. 1 is a schematic diagram showing the general construction of an inkjet printer according to a first embodiment of the present invention.

An inkjet printer according to a first embodiment of the present invention will be described next. It should be noted that the direction expressions such as "front", "rear", "above", "below", "top", and "bottom" are used throughout the description to define the various parts when a printer is disposed in an orientation in which it is intended to be used. FIG. 1 shows an inkjet printer 101 according to the first embodiment includes four inkjet heads 1 for ejecting ink from nozzles (not shown) onto a sheet of paper, a feeding mechanism 102 for supplying the sheet to the four inkjet heads 1, and a controller 103 for controlling operations of the four inkjet heads 1, and the feeding mechanism 102. The inkjet printer 101 is a line printer in which the four inkjet heads 1 are positioned and fixed in a sheet conveying direction at given intervals in order that a longitudinal length of each inkjet head 1 is orthogonal to the sheet conveying direction. In this embodiment, the sheet is fed from right to left in FIG. 1.

Figure 2:
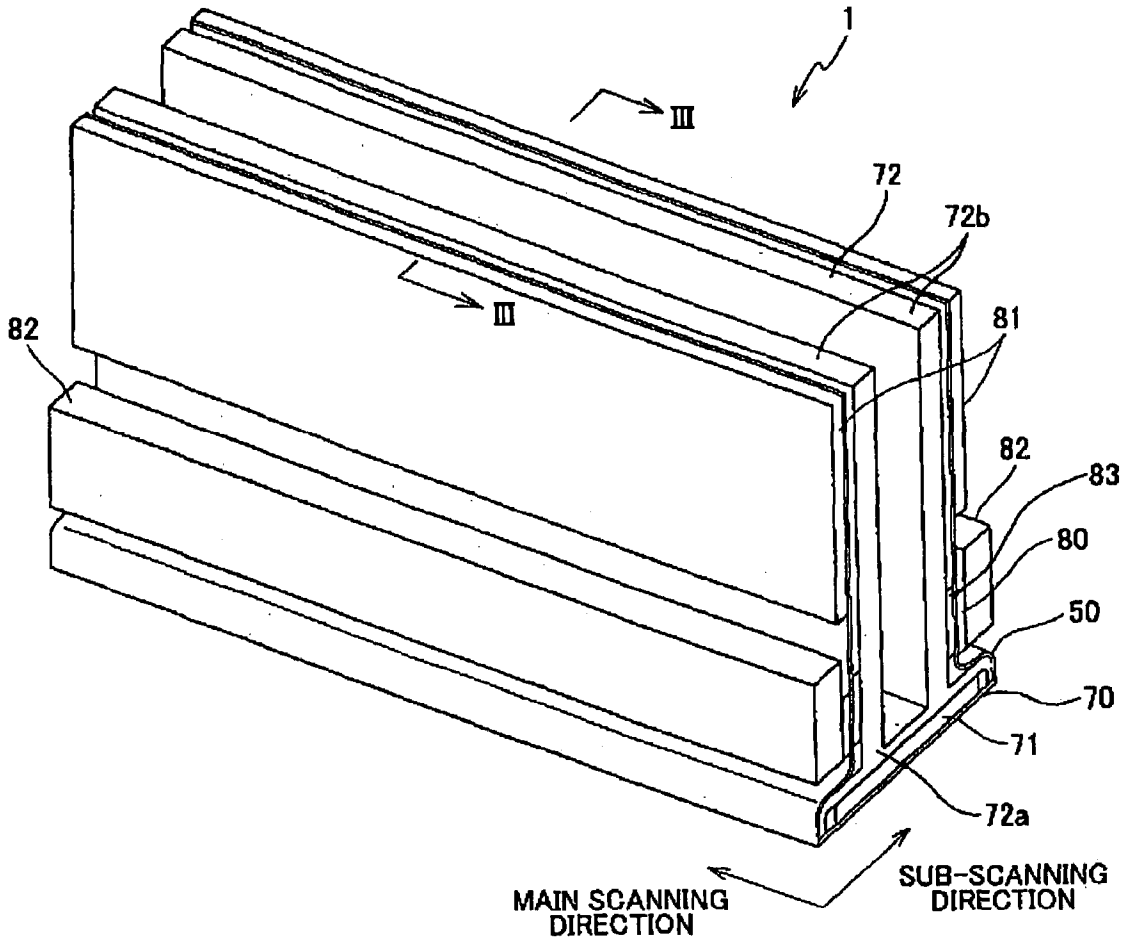
FIG. 2 is a perspective view of the inkjet head provided in the inkjet printer of FIG. 1.
Figure 3:
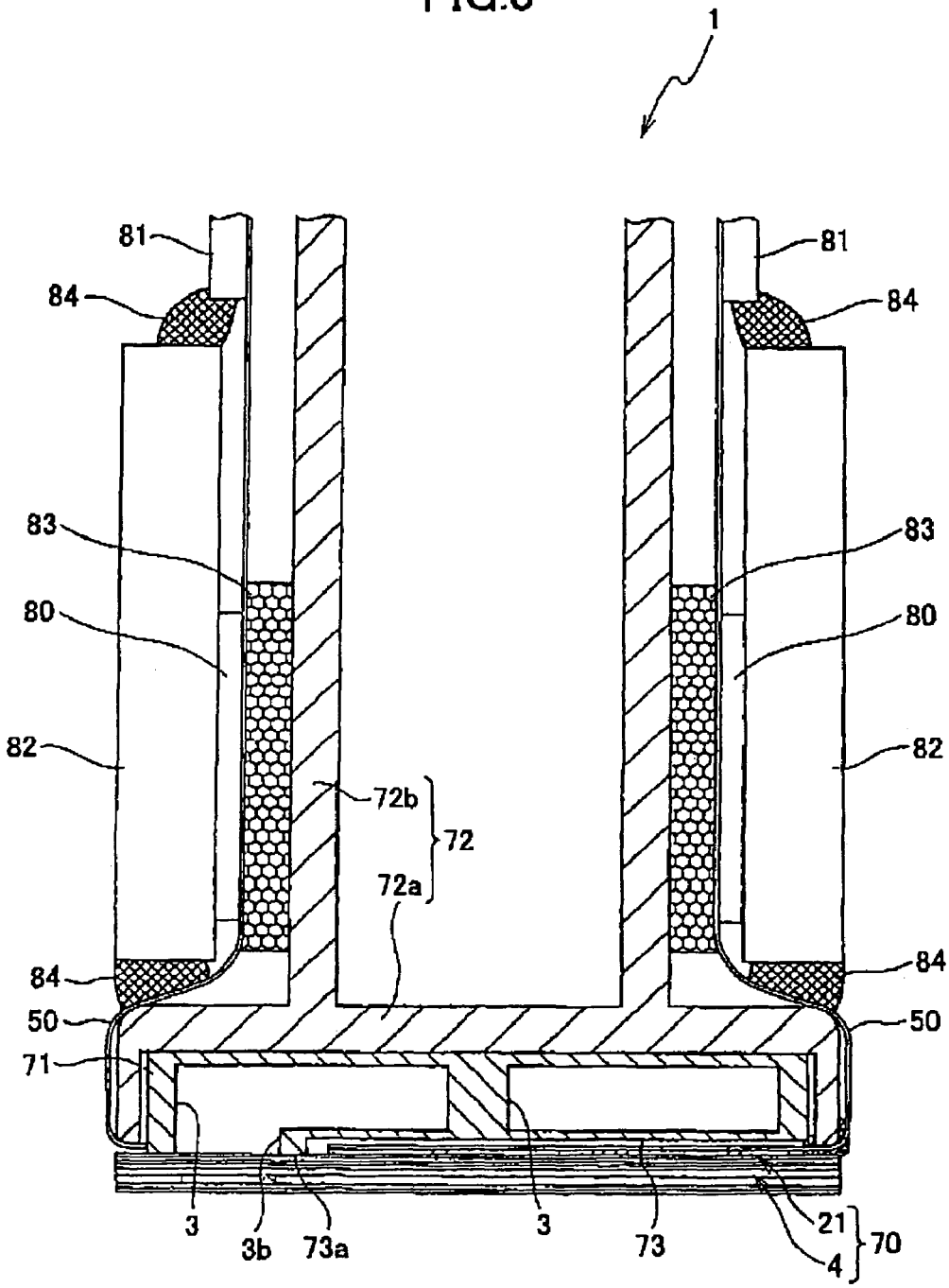
FIG. 3 is a cross-sectional view taken along lines of III-III in FIG. 2.

First, the inkjet head 1 will be described in detail. FIGS. 2 and 3 show the inkjet head 1 having a main head member 70 disposed at the bottom end thereof. The main head has a rectangular cross-section. The main head members 70 of the inkjet heads 1 are juxtaposed so that their longitudinal lengths extend orthogonal to the sheet conveying direction. Each of the main head members 70 has a bottom surface that opposes the sheet supplied by the feeding mechanism 102. A plurality of the nozzles 8 with microsize hole diameters are provided on the bottom surface of the main head member 70 (see FIGS. 5 and 6). The four main head members 70 eject ink of one of the colors magenta, yellow, cyan, and black.

The inkjet head 1 further includes a base block 71 disposed on the top surface of the main head member 70. The base block 71 has an ink reservoir 3 for accommodating ink to be supplied to the main head member 70.

The main head member 70 includes: a channel unit 4 in which ink channels are formed; and a plurality of actuator units 21 bonded to the top surface of the channel unit 4. The actuator units 21 have a laminated structure in which a plurality of thin plates are stacked and bonded together. Flexible printed circuits (FPCs) 50 are bonded to the top surfaces of the actuator units 21 for supplying electric power to the same. The FPCs 50 are led out from the actuator units 21 on the both sides thereof. A base block 71 is formed of a metal material such as stainless steel. The ink reservoir 3 is provided inside the base block 71 and has a hollow part. The hollow part has a substantially rectangular parallelepiped shape extending in the longitudinal direction of the base block 71.

The bottom surface 73 of the base block 71 protrudes downward from openings 3*b* of the ink reservoir 3. The base block 71 contacts the channel unit 4 only in regions 73*a* around the openings 3*b* on the bottom surface 73. Accordingly, regions other than the openings 3*b* of the bottom surface of the base block 71 are separated from the main head member 70, forming spaces therebetween. The actuator units 21 are disposed in respective these spaces.

The inkjet head 1 includes a holder 72. The holder 72 includes a retaining part 72*a*, and a pair of plate-shaped protruding parts 72*b* protruding perpendicularly to the top surface of the retaining part 72*a* and forming a prescribed gap therebetween. The base block 71 is bonded and fixed in a recess formed in the bottom surface of the retaining part 72*a*. The FPCs 50 leading out from the actuator units 21 are arranged along the surface of the protruding parts 72*b* through an elastic material 83 such as a sponge material. A driver IC 80 is provided on each FPC 50 disposed on the surface of the protruding part 72*b* of the holder 72. The FPC 50 is electrically connected by soldering to both the driver IC 80 and the actuator unit 21 for transferring drive signals from the driver IC 80 to the actuator unit 21.

A heat sink 82 substantially shaped like a rectangular parallelepiped is disposed in close contact with the outer surface of the driver IC 80 for efficiently dissipating heat generated by the driver IC 80. A circuit board 81 is disposed on the outer side of each FPC 50 above the driver IC 80 and heat sink 82. Seal members 84 are affixed between the top surface of the heat sink 82 and the circuit board 81 and between the bottom surface of the heat sink 82 and the FPC 50.

Figure 4:
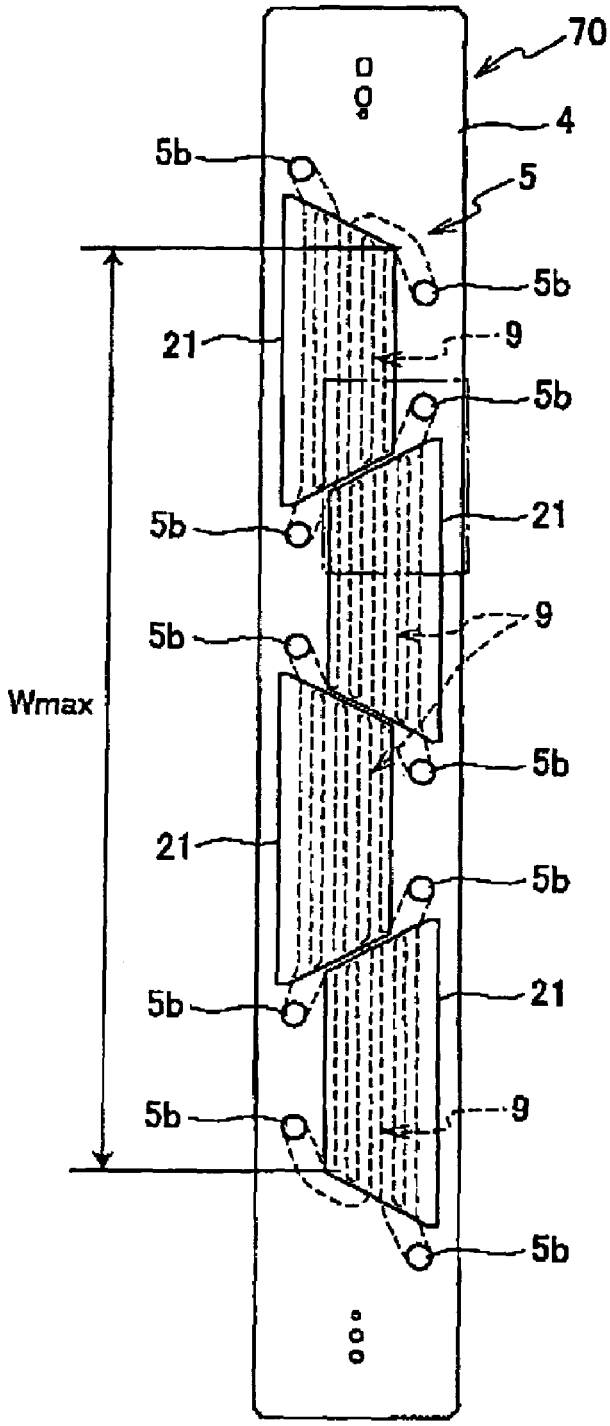
FIG. 4 is a plan view of a main head member in the inkjet head.
Figure 5:
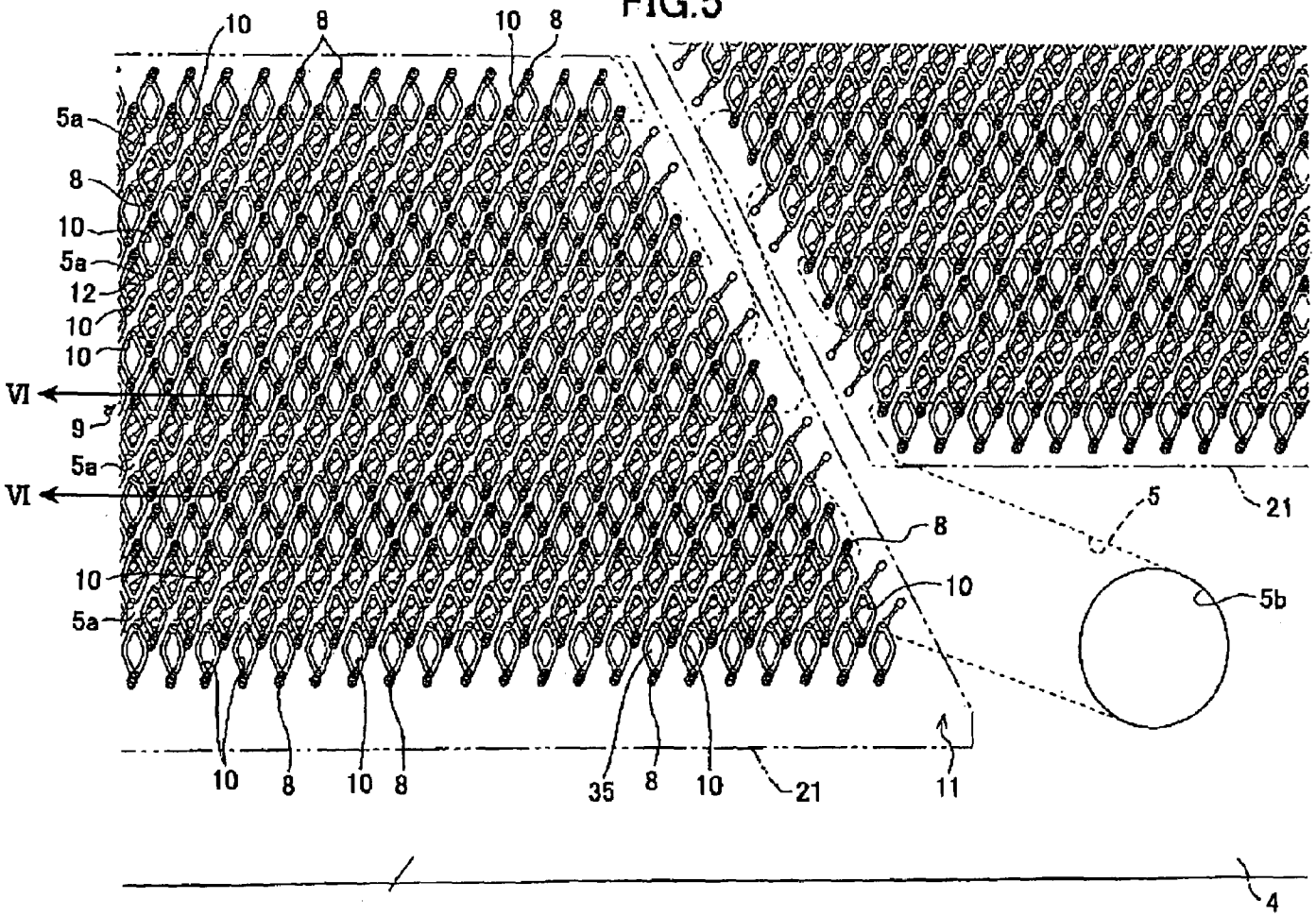
FIG. 5 is an enlarged view showing a part of a main head member.

Next, the structure of the main head member 70 will be described in detail. As shown in FIGS. 4 and 5, the main head member 70 includes the channel unit 4 having pressure chamber groups 9 configured of numerous flat, substantially diamond-shaped pressure chambers 10 and nozzles 8. A plurality of the trapezoidal actuator units 21 are disposed in a staggered arrangement of two rows and bonded to the top surface of the channel unit 4. Each of the actuator units 21 is positioned with the parallel sides (top and bottom sides) aligned with the longitudinal direction of the channel unit 4, while the slanted sides of neighboring actuator units 21 are opposed to each other at a short distance in the widthwise direction of the channel unit 4.

Ink ejection regions are formed on the bottom surface of the channel unit 4 corresponding to regions on which the actuator units 21 are bonded. As shown in FIG. 5, a plurality of nozzles 8 are arranged in a matrix on the surface of the ink ejection regions. Each of the pressure chambers 10 is in fluid communication with a single nozzle 8. The pressure chambers 10 are also arranged in a matrix. A single pressure chamber group 9 is configured of a plurality of the pressure chambers 10 disposed on the top surface of the channel unit 4 in correspondence with the area in which a single actuator unit 21 is bonded.

Each nozzle 8 tapers narrower toward the tip. The nozzle is in fluid communication with a submanifold 5*a* via the pressure chamber 10 and an aperture 12. The submainfold 5*a*is a branch channel of the manifold 5. As shown in FIG. 5, a plurality of openings 5*b* are formed in the top surface of the channel unit 4 and communicate with the openings 3*b* formed in the bottom surface of the base block 71. Ink in the base block 71 is supplied through the openings 3*b* and the openings 5*b* to the submanifold 5*a*. In FIG. 5, the pressure chambers 10 (pressure chamber groups 9), apertures 12, and nozzles 8 have been depicted with solid lines, although they are beneath the actuator units 21 and should be depicted in dotted lines.

As shown in FIG. 4, the plurality of nozzles 8 are formed on the bottom surface of the channel unit 4 corresponding to the actuator units 21. However, it should be noted that all of the plurality of nozzles 8 are not used for ejecting ink to the sheet. In other words, the nozzles 8 on the area having a substantially same number of nozzles in the sheet conveying direction are operated by, the actuator units 21 in order to eject ink. Thus, the nozzles 8 used to eject ink by the actuator units 21 define a maximum printable width Wmax of the printer 101 on which the inkjet head 1 can print.

Figure 6:
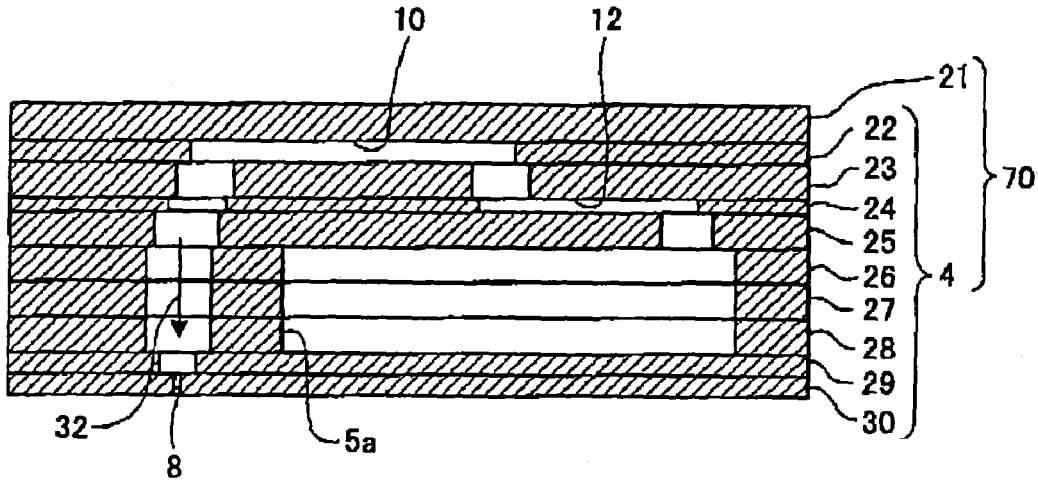
FIG. 6 is a cross-sectional view taken along lines of VI-VI in FIG. 5.

Next, the cross-sectional structure of the main head member 70 will be described. Referring to FIG. 6, the nozzle 8 is in fluid communication with a submanifold 5*a* via the pressure chamber 10 and an aperture 12. Accordingly, an individual ink channel 32 is formed in the main head member 70 for each pressure chamber 10 and extends from the outlet of the submanifold 5*a* to the nozzle 8 via the aperture 12 and the pressure chamber 10.

Figure 7:
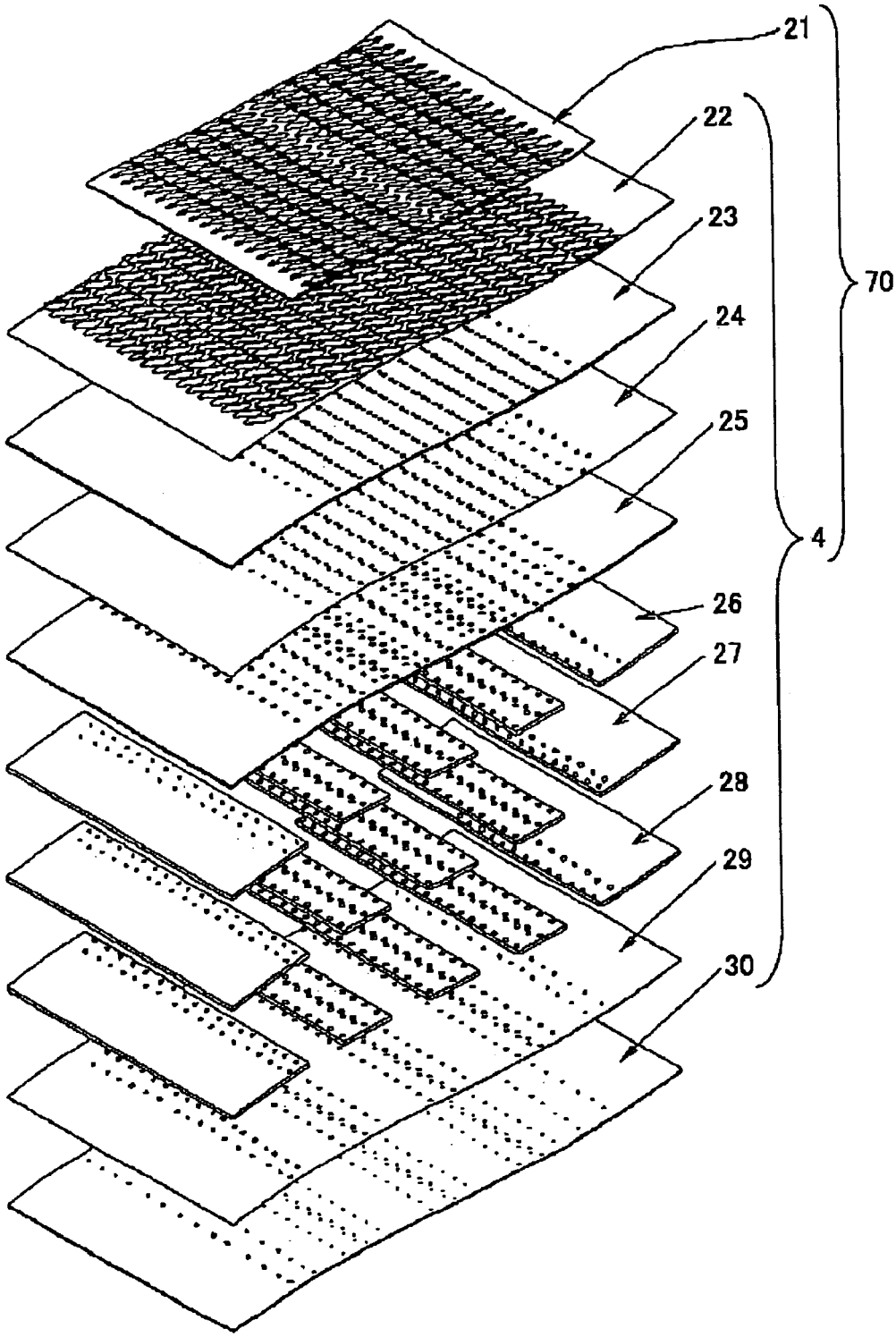
FIG. 7 is an exploded perspective view showing a portion of the main head member.

As shown in FIG. 7, the main head member 70 has a laminated structure that includes a total of ten stacked sheets. From top to bottom these sheets include the actuator unit 21, a cavity plate 22, a base plate 23, an aperture plate 24, a supply plate 25, manifold plates 26, 27, and 28, a cover plate 29, and a nozzle plate 30. The channel unit 4 is configured of nine of the above metal plates, excluding the actuator unit 21.

Figure 8A:
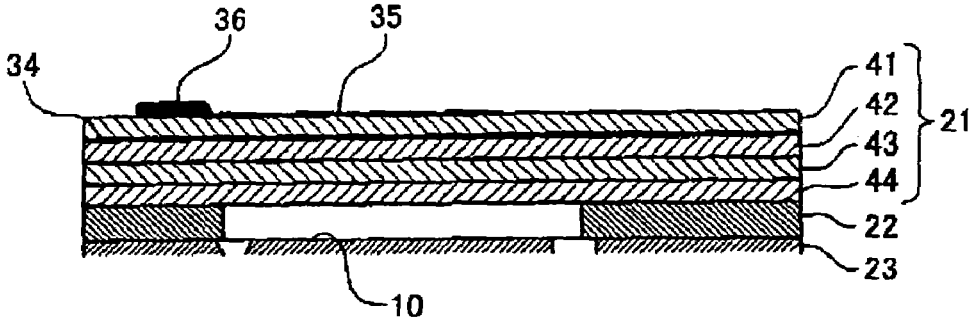
FIG. 8(*a*) is an enlarged cross-sectional view showing an actuator unit.
Figure 8B:
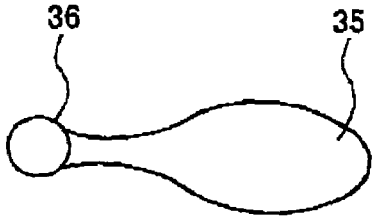

As shown in FIG. 8, the actuator unit 21 includes four laminated piezoelectric sheets 41-44. The topmost sheet of the sheets 41-44 has active layer portions (hereinafter referred to as the "active layer") when a voltage is applied from electrodes, while the remaining three sheets remains inactive layers.

Referring to FIG. 6, the cavity plate 22 is made from metal and provided with a plurality of substantially diamond-shaped openings corresponding to the pressure chambers 10. The base plate 23 is made of metal and provided with a communication hole connecting the pressure chamber 10 and aperture 12, and another communication hole connecting the pressure chamber 10 to the nozzle 8 for each pressure chamber 10 in the cavity plate 22. The aperture plate 24 is a metal plate provided with the aperture 12 communicating the pressure chamber and the submanifold 5*a*, and a communication hole connecting the pressure chamber 10 and the nozzle 8. The holes in the aperture plate 24 is made by etching. The supply plate 25 is a metal plate provided with a communication hole connecting the aperture 12 and the submanifold 5*a*, and a communication hole connecting the pressure chamber 10 and the nozzle 8.

The manifold plates 26, 27, and 28 are each provided with a hole for configuring the submanifold 5*a* when the plates are laminated together, and a communication hole connecting the pressure chamber 10 to the nozzle 8. The cover plate 29 is a metal plate provided with a communication hole connecting the pressure chamber 10 to the nozzle 8. The nozzle plate 30 is a metal plate provided with a nozzle 8 for each pressure chamber 10 in the cavity plate 22.

These nine metal plates are aligned and stacked together to form the ink channel 32 shown in FIG. 6. The ink channel 32 begins from the submanifold 5*a* proceeding upward, extends horizontally in the aperture 12 before again proceeding upward, again extends horizontally in the pressure chamber 10, and then proceeds downward to the nozzle 8, first at a slant away from the aperture 12 and then straight downward.

Next, the structure of the actuator unit 21 will be described. Referring to FIG. 8(*a*), the actuator unit 21 is stacked on the cavity plate 22, which is the topmost layer of the channel unit 4. An electrode 35 is bonded to the top surface of the actuator unit 21.

As shown in FIG. 8(*a*), the actuator unit 21 includes the four piezoelectric sheets 41-44, each having the same thickness of approximately 15 μm. These piezoelectric sheets 41-44 are continuous laminated plates (continuous planar layers) that span the plurality of pressure chambers 10 formed in a single ink ejection region of the main head member 70 By disposing the piezoelectric sheets 41-44 as continuous planar layers over the plurality of pressure chambers 10, the electrodes 35 can be densely arranged on the piezoelectric sheet 41 using a screen printing technique. Therefore, the pressure chambers 10 can also be densely arranged at positions corresponding to the electrodes 35, enabling the printing of high-resolution images. The piezoelectric sheets 41-44 are formed of ferroelectric ceramics such as lead zirconate titanate (PZT).

The electrodes 35 are formed on top of the piezoelectric sheet 41, the topmost layer. A common electrode 34 formed as a sheet with a uniform thickness of approximately 2 μm is interposed between the piezoelectric sheets 41 and 42. Any electrodes are not provided between the piezoelectric sheets 42 and 43. Both the electrodes 35 and the common electrode 34 are formed of a metal material such as Ag—Pd.

Each of the electrodes 35 is planar with a thickness of approximately 1 μm and is substantially diamond-shaped, as shown in FIG. 8(*b*), similar to that of the pressure chambers 10 shown in FIG. 5. A circular land 36 having a diameter of approximately 160 μm protrudes from one acute angle end of the electrode 35 and is electrically connected to the same. The land 36 is formed of a metal such as gold containing glass frit. As shown in FIG. 8(*a*), the land 36 is bonded to the surface of an extended part of the electrode 35. The land 36 is electrically joined to a contact provided on the FPC 50.

The common electrode 34 is grounded at an area not shown in the drawing so that all of the common electrodes 34 are maintained equally at a ground potential for all areas corresponding to the pressure chambers 10. Further, the electrodes 35 are connected to the driver ICs 80 via the lands 36 and the FPCs 50, which include a plurality of independent lead wires for each electrode 35 in order to independently control the potential corresponding to each pressure chamber 10 (see FIGS. 2 and 3).

Next, a method of driving the actuator unit 21 will be described. The polarizing direction of the piezoelectric sheet 4i is equal to the direction of its thickness. Specifically, the actuator unit 21 has a unimorph structure in which the single piezoelectric sheet 41 on the top side (separated from the pressure chamber 10) has an active layer, while the three piezoelectric sheets 42-44 on the bottom side (near the pressure chamber 10) are inactive layers. Accordingly, when a prescribed positive or negative voltage is applied to the electrode 35, and the directions of the electric field and polarization are the same, areas in the piezoelectric sheet 41 interposed between the electrodes 34 and 36 and over which a voltage is applied function as active layers to compress in a direction orthogonal to the polarizing direction due to the transverse piezoelectric effect.

However, since the piezoelectric sheets 42-44 are not affected by the electric field and therefore do not spontaneously compress, a difference in strain between the piezoelectric sheet 41 and the piezoelectric sheets 42-44 is produced in the direction orthogonal to the polarizing direction, causing all of the piezoelectric sheets 41-44 to deform in a convex shape on the inactive side (unimorph deformation). As shown in FIG. 8(*a*), since the bottom surface of the piezoelectric sheets 41-44 is fixed to the top surface of the cavity plate 22, which serves to partition the pressure chambers, the piezoelectric sheets 41-44 effectively deform in a convex shape toward the pressure chamber side. As a result, the capacity of the pressure chamber 10 decreases, increasing the pressure of the ink and causing ink to eject from the nozzle 8. When the electrodes 35 are subsequently returned to the same potential as the common electrode 34, the piezoelectric sheets 41-44 return to their original shape and the pressure chamber 10 returns to its original capacity, drawing ink in from the manifold 5.

Next, the feeding mechanism 102 that supplies the sheet to the inkjet heads 1 described above will be described. As shown in FIG. 1, the feeding mechanism 102 includes a first sheet tray 111, a second sheet tray 112, and a third sheet tray 113 stacked vertically; pickup rollers 121-123 for feeding a sheet accommodated within the first through third sheet trays 111-113 respectively: conveying rollers 131-133 and conveying belts 141-143 disposed in correspondence to the respective sheet trays 111-113 for conveying the sheet from the sheet trays 111-113 to the inkjet head 1; and-roller drive motors 151-153 for driving the respective conveying rollers 131-133.

Figure 9:
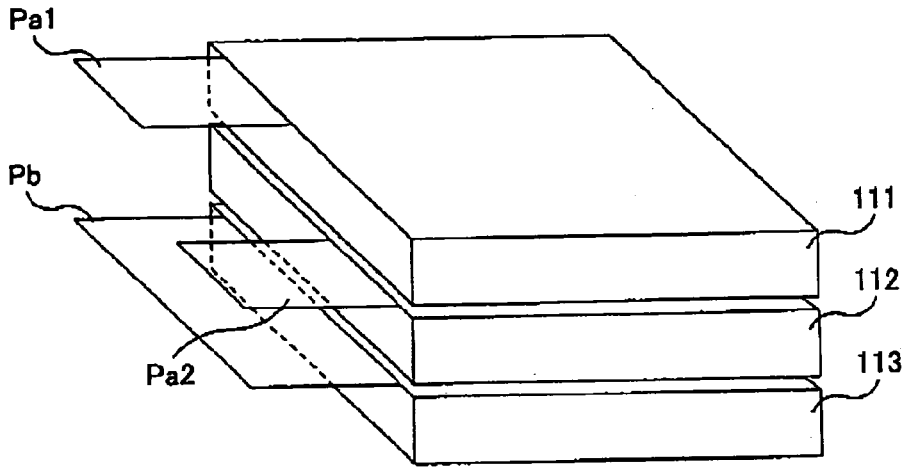
FIG. 9 is a perspective view of sheet trays to supply a sheet.

The three sheet trays 111-113 are detachably mounted in the casing (not shown) of the inkjet printer 101. Referring to FIGS. 1 and 9, the third sheet tray 113 is located at the lowest position of the three trays to accommodate a sheet Pb having a width substantially equal to the maximum printable width Wmax of the inkjet head 1. The pickup roller 123 feeds the sheet Pb from the third sheet tray 113 one sheet at a time. The sheet Pb fed by the pickup roller 123 is then conveyed to the inkjet heads 1 by the conveying roller 133, conveying belt 143, and conveying rollers 134.

On the other hand, the upper two sheet trays 111 and 112 accommodate a sheet Pa having a width Wa. The sheet trays 111 and 112 have a narrower width than that of the third sheet tray 113. Therefore, the sheet Pa in the sheet trays 111 and 112 has the width Wa which is narrower than the width Wmax of the sheet in the third sheet tray 113. The sheet Pa in the first sheet tray 111 and second sheet tray 112 is fed one sheet at a time by the corresponding pickup roller 121 and 122, and then conveyed to the corresponding one of first and second printing areas with respect to the inkjet heads 1 by the conveying rollers 131, 132, the conveying belts 141, and the conveying rollers 134, respectively.

The first printing area P1 is provided with reference to the inkjet heads 1 for printing the sheet Pa1 fed from the first sheet tray 111. The second printing area P2 is also provided with reference to the inkjet heads 1 for printing the sheet Pa2 fed from the second sheet tray 112.

Figure 10:
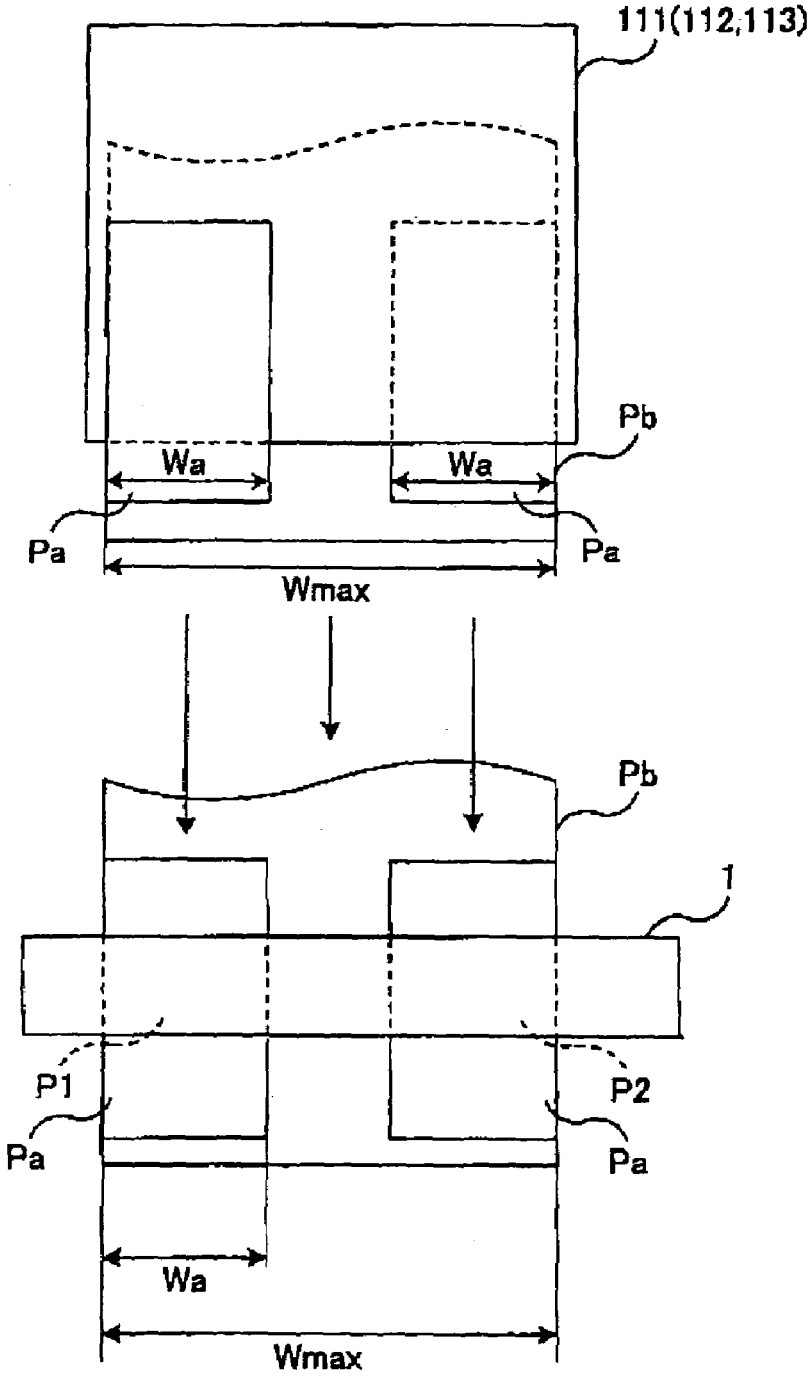
FIG. 10 is a plan view showing the general construction of an inkjet printer and the sheet trays.

Referring to FIGS. 9 and 10, the first and second areas P1 and P2 are positioned on both sides of the widthwise direction of the sheet with respect to the inkjet heads 1. The first and second areas P1 and P2 do not overlap each other (width Wa of the sheet Pa1, Pa2<Wmax/2). In other words, the two printing areas P1 and P2 are positioned near or on both ends of the overall printable area by the inkjet head 1, respectively. Hence, the middle area between the two sheet printing areas P1 and P2 in the maximum printable area Wmax is not used when the sheet Pa from either one of the first and second sheet trays 111 and 112 is printed. The middle area is only used when the wider sheet Pb is supplied and printed from the third sheet tray 113.

After the sheet Pa and sheet Pb fed to the inkjet heads 1 are printed by the inkjet heads 1, conveying rollers 135 and a conveying belt 144 discharge the sheet in a direction as shown by the arrow in FIG. 1.

During this process, the rotational drive force of the roller drive motors 151-153 is transferred to the respective pickup rollers 121-123 and conveying rollers 131-133 to rotate. Paper sensors 161-163 are positioned in the sheet trays 111-113 respectively for detecting whether the sheet Pa or sheet Pb exists in the respective sheet trays 111-113. Further, feeding sensors 171 and 112 are positioned in the first and second sheet trays 111 and 112 for detecting whether the sheet Pa has been fed from the respective trays.

Figure 11:
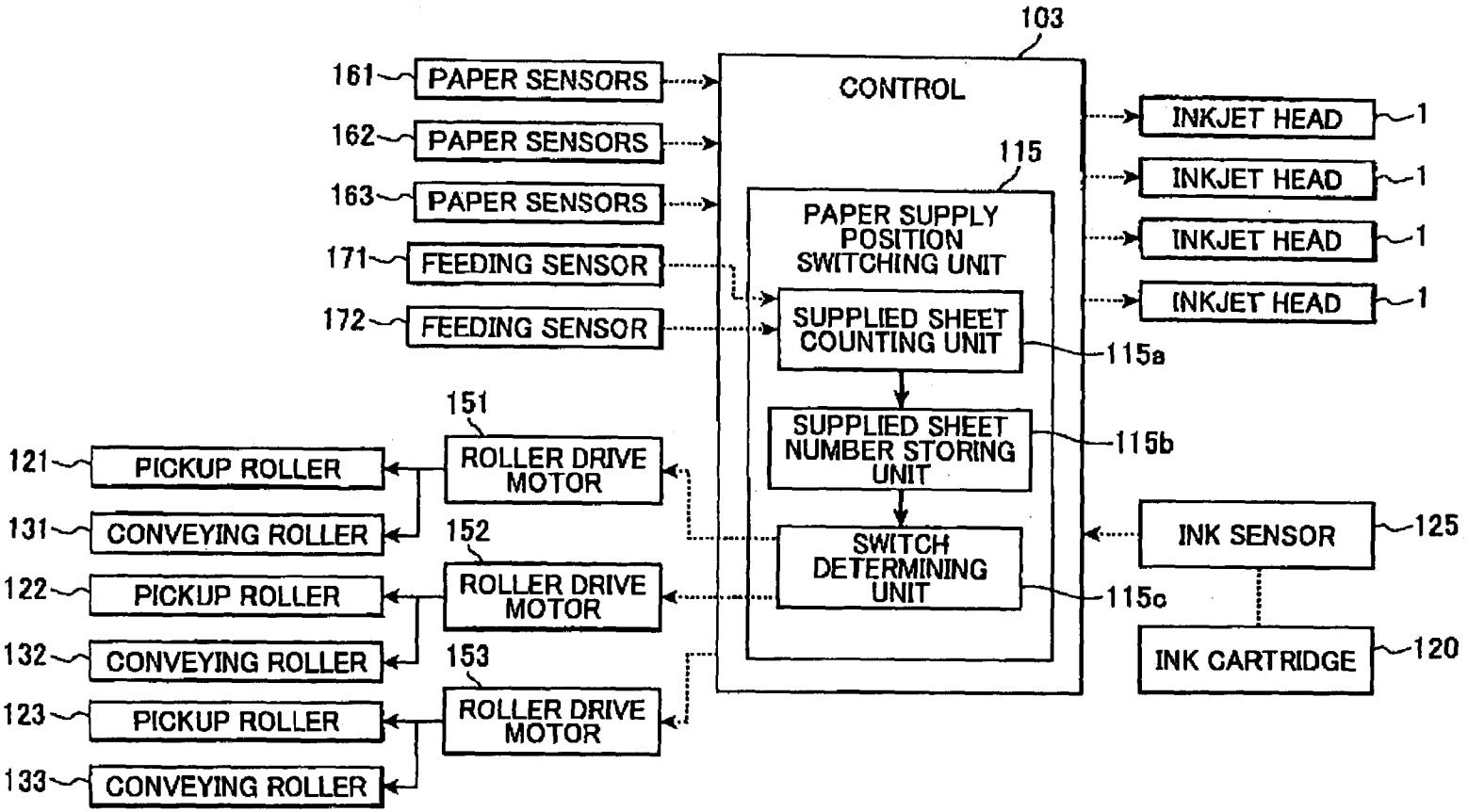
FIG. 11 is a block diagram showing a control system of the inkjet printer.

Next, the controller 103 will be described referring to FIG. 11. The controller 103 controls various operations of the inkjet printer 101, including the ejection of ink from the four inkjet heads 1, the supply of sheet to the inkjet heads 1 by the feeding mechanism 102, and the discharge of sheet that has been printed by the inkjet heads 1. The controller 103 is configured of a central processing unit (CPU), a read-only memory (ROM) for storing programs executed by the CPU and data used in the programs, a random access memory (RAM) for temporarily storing data when a program is executed, a non-volatile memory such as an electrically erasable programmable read-only memory (EEPROM), input/output interfaces, and buses.

The controller 103 receives image data for printing from a host computer (not shown) and various signals supplied from a remaining ink sensor 125, the sheet sensors 161-163, and the feeding sensors 171 and 172. The remaining ink sensor 125 detects the amount of ink remaining in an ink cartridge 120. The controller 103 outputs image data for printing, and timing data for ink ejection to the four inkjet heads 1. The controller 103 also generates drive signals to each of the roller drive motors 151-153.

However, the sheet keeps being printed at only the same printing area along the widthwise direction of the sheet, when the sheet Pa having a narrower width than the maximum printable width Wmax is printed. The nozzles 8 used in the printing area are usually used more frequently than the other nozzles 8. In this case, specific areas of the piezoelectric sheets 41-44 in the actuator unit 21 corresponding to nozzles at this high-frequency printing area will be deformed more frequently, leading to deterioration due to generated heat, irregularity in polarization, and irregularity in the amount of deformation of the piezoelectric sheets 41-44, that is, a change in the amount of ink ejected from the nozzles 8.

Hence, when the wider sheet Pb is printed under these circumstances, the printing quality at portions corresponding to the high-frequency printing area will be degraded than that at other, printing areas. Further, specific portions of the conveying rollers 131-133 and the conveying belts 141-143 that feed a sheet to this high-frequency printing area may deteriorate. Accordingly, there might be a possibility that these components will become unable to supply the sheet smoothly, necessitating their early replacement.

In the inkjet printer 101 according to the first embodiment, the controller 103 is provided with a sheet supply position switching unit 115 for switching the sheet tray from which the sheet is supplied when the narrower sheet Pa is printed. The sheet supply position switching unit 115 switches the first and second sheet trays 111 and 112 based on the number of printed sheets at each of the two printing areas P1 and P2.

The sheet supply position switching unit 115 includes a supplied sheet counting unit 115*a*, a supplied sheet number storing unit 115*b*, and a switching determining unit 115*c*. The supplied sheet counting unit 115*a* counts the numbers of sheets N1 and N2 supplied from the first and second sheet trays 111 and 112 to the inkjet heads 1, respectively in response to a signal from the feeding sensors 171 and 172. The feeding sensors 171 and 172 detect that the sheet is fed out from the first and second sheet trays 111 and 112, respectively. The supplied sheet number storing unit 115*b* stores an output of the supplied sheet counting unit 115*a*. The switching determining unit 115*c* determines whether to switch the sheet tray in accordance with the numbers of sheets N1 and N2. Here, the number of sheets N1 and N2 are cumulative totals for the sheets fed from the paper tray to the inkjet heads 1 since the inkjet printer 101 is used for printing. In other words, the numbers of printed sheets N1 and N2 are equal to zero, when the printer 101 is activated for using for the first time. Since then, the numbers of printed sheets N1 and N2 maintains being counted.

Figure 12:
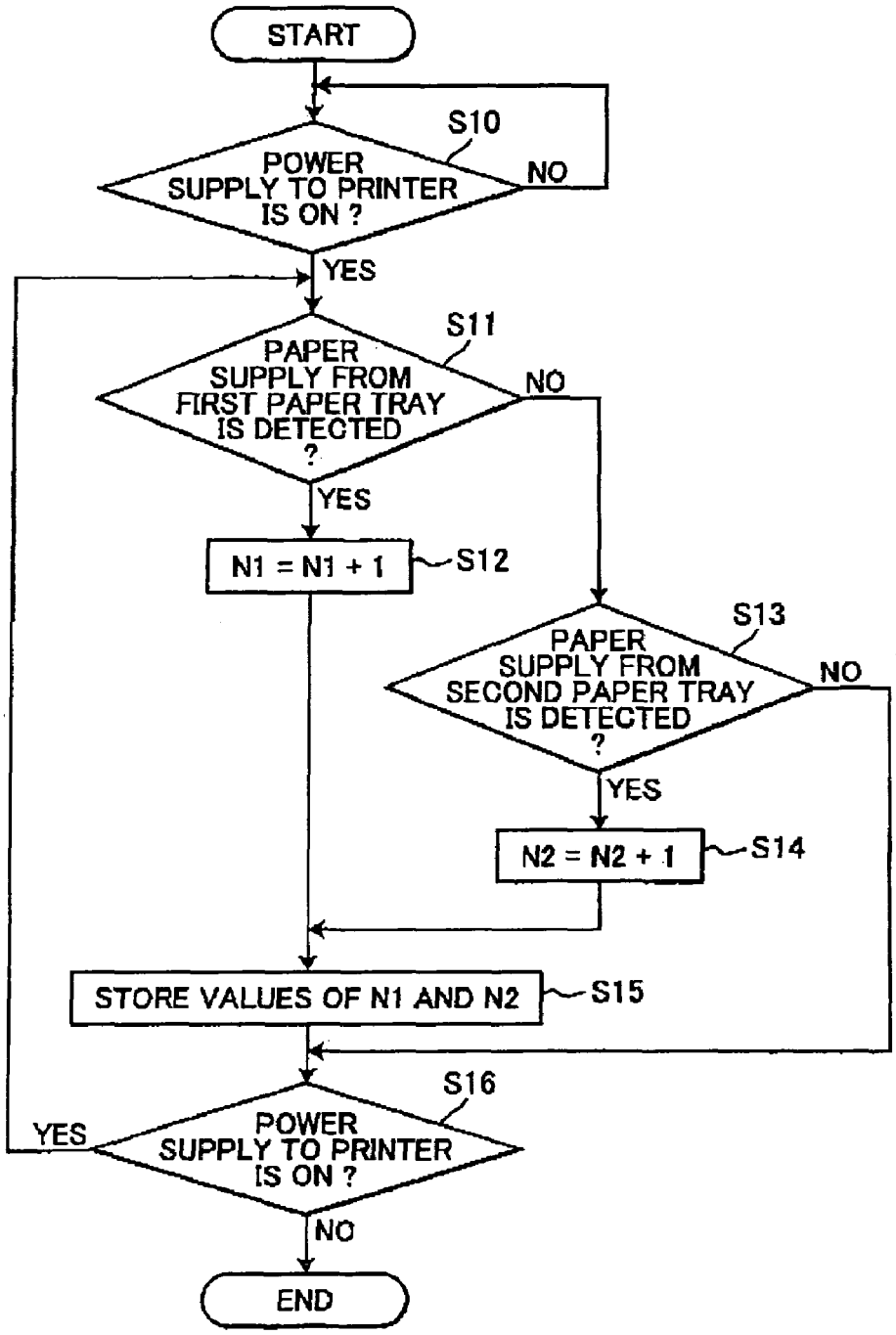
FIG. 12 is a flowchart illustrating a process to counting a sheet.

Next, a process for switching the sheet supply area executed by the sheet supply position switching unit 115 will be described with reference to the block diagram in FIG. 11 and the flowcharts in FIGS. 12 and 13 This process is repeatedly executed while the inkjet head printer 101 maintains being fed.

First, the process for counting the number of sheets N1 and N2 fed from the first and second sheet trays 111 and 112 will be described referring to the flowchart of FIG. 12. The numbers of sheets N1 and N2 are counted by the supplied sheet counting unit 115*a* every time a sheet is supplied from the first and second sheet trays 111 and 112, respectively. The numbers N1 and N2 are then stored in the supplied sheet number storing unit 115*b*. Hence, the latest values of the numbers N1 and N2 have been stored in the supplied sheet number storing unit 115*b*, which is configured of a nonvolatile memory, such as EEPROM.

In S10 the controller 103 determines that electric power is supplied to the inkjet printer 101. If the electric power is supplied to the printer 101 (S10:YES), the process advances to S11. Otherwise (S10:NO), the controller 103 maintains monitoring if the electric power is supplied to the printer 101.

In S11, the sheet supply position switching unit 115 then determines whether the sheet is fed from the first sheet tray 111 based on an output of the feeding sensor 171. If the sheet has been supplied from the first sheet tray 111 (S11: YES), then in S11 the sheet supply-position switching unit 115 increments the number N1 by one (S12). However, if the sheet has not been fed from the first sheet tray 111 (S11: NO), then in S13 the sheet supply position switching unit 115 determines whether the sheet has been supplied from the second sheet tray 112 based on an output of the feeding sensor 172. If the sheet has been supplied from the second sheet tray 112 (S13; YES); then in S14 the sheet supply position switching unit 115 increments the number N2 by one. In S15 the sheet supply position switching unit 115 then stores new values of the numbers N1 and N2 in the supplied sheet number storing unit 115*b* and go to S16. In S16, the controller 103 determines if power supply to the printer 101 is maintained on. If power supply to the, printer 101 is maintained on (S16:YES), the process then returns to S11. Otherwise, the process goes to END.

As described above, the controller 103 maintains counting the number of sheets N1, N2 at the corresponding printing area, while the power supply to the printer 101 is ON.

Figure 13:
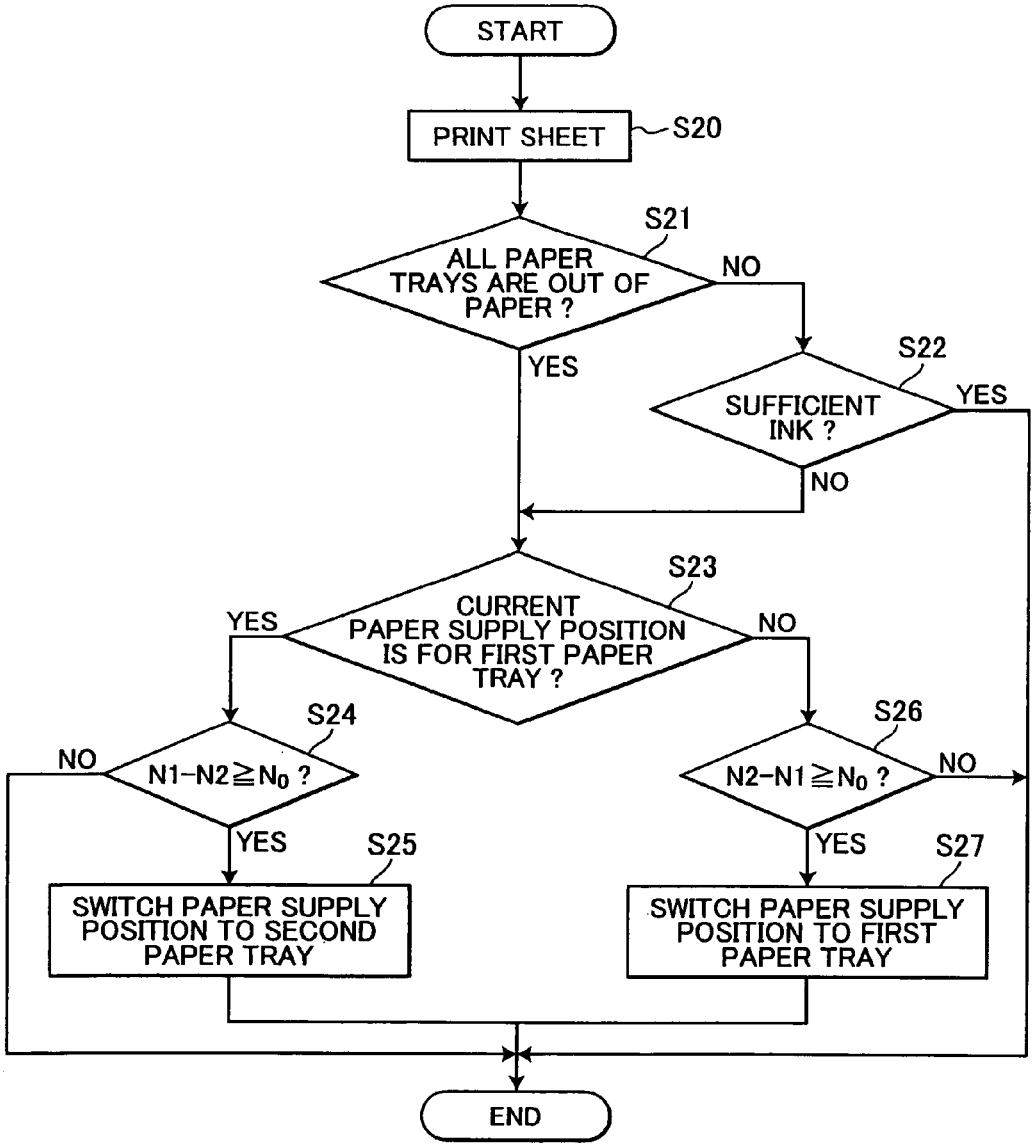
FIG. 13 is a flowchart illustrating a process for determining whether to switch the sheet supply area.
Figure 14:
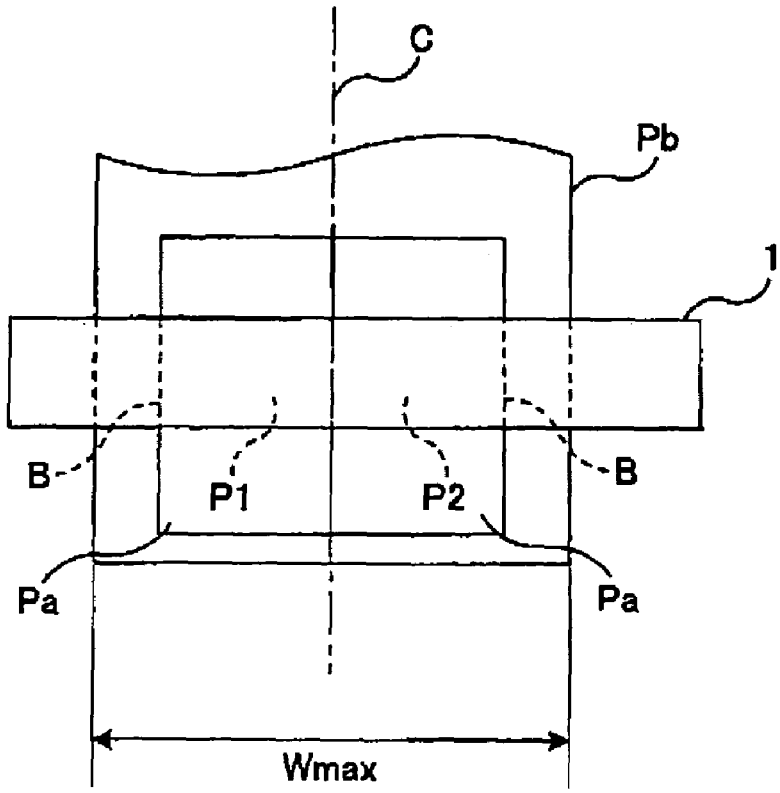
FIG. 14 shows a modification of the first embodiment corresponding to FIG. 10.

Simultaneously, the controller 103 determines if a sheet supply area should be switched by means of the process of FIG. 13. In S20, the controller 103 sends a signal to the inkjet heads 1 in order to print on a sheet. The switch determining unit 115*c* determines whether to switch the sheet supply area, in accordance with a flowchart illustrated in FIG. 13. In S21 the switch determining unit 115*c* determines whether the sheet remains in any of the sheet trays 111-113 based on outputs of the sheet sensors 161-163. If the sheet does remain in at least one of the sheet trays (S20: NO), then in S22 the switch determining unit 115*c* determines whether the ink sensor 125 detects that the amount of ink in the ink cartridge 120 is sufficient. If the ink cartridge 120 includes sufficient ink for printing (S22: YES), then the inkjet head 1 is capable of printing on the sheet and the process goes to END. At this time, the switch of the sheet supply area has to be prohibited because the printer 101 maintains printing. Accordingly, the sheet supply area is not switched.

However, if the switch determining unit 115*c* determines in S21 that all three sheet trays 111-113 have no sheets therein based on outputs of the sheet sensors 161-163 (S21: YES) or in S22 that the amount of ink the ink cartridge 120 is not sufficient based on an output of the ink sensor 125 (S22: NO), then the controller 103 can not allow the inkjet head 1 to maintain printing on the sheet. When the printer 101 is subject to the above circumstances, the switch determining unit 115*c* is allowed to determine whether to switch the sheet supply position based on a difference between the numbers of sheets N1 and N2.

In S23 the switch determining unit 115*c* determines whether the current sheet supply position is the first sheet tray 111. If the current sheet supply position is the first sheet tray 111 (S23: YES), then in S24 the switch determining unit 115*c* determines whether a value obtained by subtracting the number of sheets N2 from the number of sheets N1 is greater than or equal to a prescribed number $N_0$. If $N1-N2 \geqq N_0$ (S24: YES), then the switch determining unit 115*c* determines that the number of sheets printed at the first printing area P1 (see FIG. 10) corresponding to the first sheet tray 111 is sufficiently greater than the number of sheets printed at the second printing area P2, and in S25 switches the sheet supply position from the first-sheet tray 111 to the second, sheet tray 112. More specifically, the switch determining unit 115*c* selects the roller drive motor 152 for driving the pickup roller 122 and conveying roller 132 corresponding to the second sheet tray 112 and supplying the sheet Pa from the second sheet tray 112.

However, if the current sheet supply position is the second sheet tray 112 (S23: NO), then in 526 the switch determining unit 115*c* determines whether a value obtained by subtracting the number N1 from the number N2 is greater than or equal to a prescribed number $N_0$. If $N2-N1 \geqq N_0$ (S26: YES), then the switch determining unit 115*c* determines that the number of sheets printed at the second printing area P2 (see FIG. 10) corresponding to the second sheet tray 112 is sufficiently greater than the number of sheets printed at the first printing area P1, and in S27 switches the sheet supply position from the second sheet tray 112 to the first sheet tray 111. More specifically, the switch determining unit 115*c* selects the roller drive motor 151 for driving the pickup roller 121 and conveying roller 131 corresponding to the first sheet tray 111 to supply the sheet Pa from the first sheet tray 111.

When the user loads new sheets,in the first sheet tray 111 and second sheet tray 112 or replaces the empty ink cartridge with a new ink cartridge 120, and the inkjet heads 1 are set to be capable of printing on the sheet, the sheet is supplied to the inkjet heads 1 to be printed from the new sheet supply position.

The prescribed number $N_0$ used to determine whether or not to switch the sheet supply position can be set according to the degree of deterioration of the piezoelectric sheets 41-44 corresponding to the printing areas P1 and P2, such as tens of thousands of pages.

The following advantages can be obtained by the inkjet printer 101 according to the first embodiment.

The sheet tray for supplying the sheet Pa, which is narrower than the maximum printable width Wmax, can be switched between the first and second sheet trays 111 and 112 when the number of sheets supplied from one of the sheet trays is sufficiently larger than the number of sheets supplied from the other sheet tray. More specifically, when the number of printings at a printing area corresponding to one of the sheet trays becomes higher that of the other printing area, the printing area is switched to the position corresponding to the other sheet tray, which prevents a local deterioration in part-of the piezoelectric sheets 41-44 driving the nozzles 8 in a specific range and prevents the number of usage of the nozzles 8 within that range from becoming extraordinarily high when performing continuous printing on the narrow sheet Pa. Hence, localized deterioration in printing quality can be prevented when printing, on the wider sheet Pb. Therefore, it is possible to minimize local deterioration or wear in parts constituting the feeding mechanism 102, such as the conveying rollers 131 and 132 and, the conveying belts 141 and 142 that supply the sheet to the two printing areas P1 and P2, thereby extending the life of these parts.

Since the two printing areas P1 and P2 corresponding to the first and second sheet trays 111 and 112 do not overlap, the inkjet head 1 has no nozzles 8 used for ejecting ink to both printing areas P1 and P2 when printing on the narrow sheet Pa, which prevents specific nozzles 8 in a local area from being subjected to a high number of the usage. Further, since the printing areas P1 and P2 are positions near the widthwise edges of the total printing area of the inkjet head 1, the number of printings in the widthwise center of the total printing area is lower than the regions on the widthwise edges. Accordingly, this lessens the degree of deterioration in ink ejection precision in the widthwise center region of the total printing area of the inkjet head 1. Hence, in later printing on the wider sheet Pb supplied from the third sheet tray 113, the inkjet head can print with relatively high quality in the center of the sheet Pb which is the most noticeable part.

Since the sheet supply position switching unit 115 switches the sheet supply position only when the inkjet head 1 is incapable of printing, the sheet supply position and, in association, the printing area are not switched during printing a plurality of pages consecutively, which prevents a change in printing quality during printing a plurality of pages consecutively.

Next, modifications of the first embodiment described above will be described, wherein similar elements and components are designated by the same reference numerals to avoid duplicating description.

The sheet supply position switching unit 115 may switch the sheet supply area when the inkjet head 1 is capable of printing, such as when at least one of the sheet trays 111-113 has sheet and the ink cartridge 120 has sufficient ink remaining. With this construction, when the controller 103 transmits a print start signal to the inkjet head 1, for example, the sheet supply position switching unit 115 does not switch the sheet supply trays. Accordingly, the sheet supply trays is prevented from being switched while a plurality of sheets have been printed continuously.

The inkjet printer 101 of the first embodiment is configured to switch, the sheet supply tray when the difference between the numbers N1 and N2 for the first and second sheet trays 111 and 112 reaches or exceeds a prescribed number. Alternatively, when one of the sheet tray is switched to the other sheet tray for printing, the supplied sheet counting unit 115*a* can first initialize the numbers N1 and N2 to zero and then start counting the sheet supplied from the first and second paper trays 111 and 112. At this time, both of the numbers N1 and N2 can be initialized to zero. Alternatively, only the number of sheets N1 or N2 supplied from the switched paper tray can be initialized to zero. Thus, the inkjet printer 101 may be configured to switch the sheet trays when the number of sheets supplied since the last time that the sheet supply position was switched reaches or exceeds a prescribed number of sheets.

While the printing areas P1 and P2 in the first embodiment described above are positioned near both widthwise sides of the total printing region of the inkjet head 1, the printing areas P1 and P2 may instead be positioned on both sides of a centerline C passing through the widthwise center of the total printing region of the inkjet head 1. In this case, borders B between the regions in which the narrower sheet Pa is printed and the regions in which no printing is performed at either printing area, that is, the borders B for regions having different printing frequencies are positioned on both sides of the total printing region. Hence, a difference in printing quality due to the difference in printing frequency appears at the borders B for regions with different printing frequencies. Since the borders B that represent the difference between printing quality are positioned away from the center of the wider sheet Pb, which is the most noticeable region of the sheet Pb, the borders B are less noticeable when printing the sheet Pb having a width almost identical to the maximum printable width Wmax of the inkjet head 1.

Alternatively, the printing areas P1 and P2 can be overlapped. However, it is preferable that the overlapped area between the two areas is as small as possible to reduce the number of nozzles 8 used in the overlapping area.

In the first embodiment described above, the sheet supply position switching unit 115 switches the sheet supply area based on the number of printing operations at both printing areas. However, the sheet supply position switching unit 115 may be configured to notice the user that it is necessary to switch the sheet supply area and have the user switch the sheet supply area in response to the notice. In this embodiment, the term "notice" means an action to tell the user that the printing area should be switched to the other printing area, such as warning.

Figure 15:
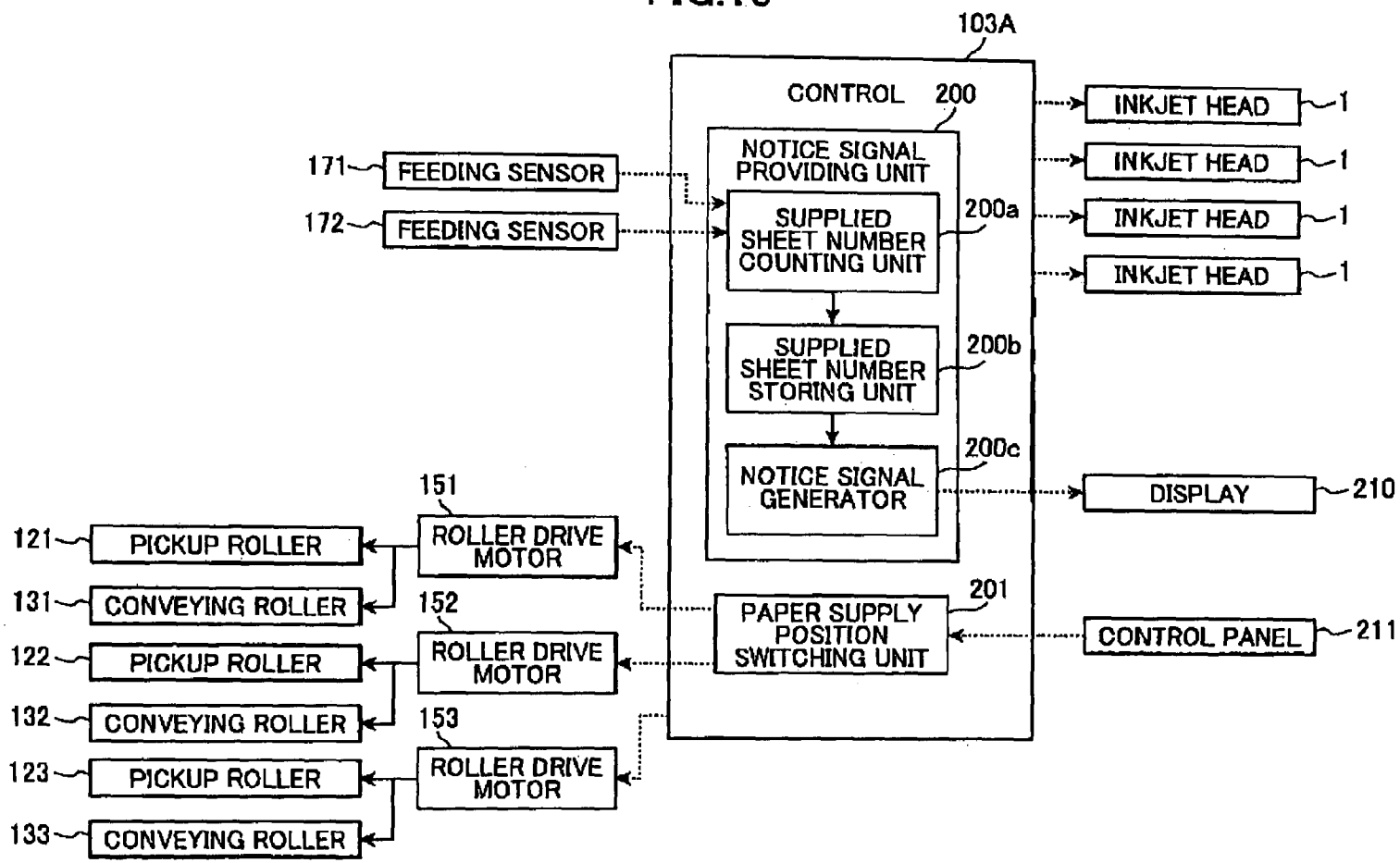
FIG. 15 is a block diagram showing a control system of an inkjet printer according to a modification of the first embodiment.

FIG. 15 shows a controller 103A that generates the above notice. The controller 103A includes a notice signal generator 200 and a sheet supply position switching unit 201. The notice signal generator 200 generates a signal noticing the user that the sheet supply position should be switched, based on the number of the printing operations at each of the printing areas P1 and P2, during printing the narrower sheet Pa. The sheet supply position switching unit 201 switches the sheet supply area after the notice signal generator 200 has generated the notice signal and the user responds the notice signal.

The notice signal generator 200 includes a supplied sheet number counting unit 200*a*, a supplied sheet number storing unit 200*b*, and a notice signal providing unit 200*c*. The supplied sheet number counting unit 200*a* counts the numbers of sheets N1 and N2 supplied from the first and second sheet trays 111 and 112 in response to an output signal from the feeding sensors 171 and 172, respectively. The supplied sheet number storing unit 200*b* stores an output of the supplied sheet number counting unit 200*a*, i.e. the number of sheets N1 and N2. The notice signal providing unit 200*c* provides a notice signal to a display 210 based on the numbers N1 and N2 stored in the supplied sheet number storing unit 200*b*. As described in the first embodiment, the supplied sheet number counting unit 200*a* counts the numbers of sheets N1 and N2 supplied from the first and second sheet trays 111 and 112 based on output signals from the feeding sensors 171 and 172. The supplied sheet number storing units 200*b* then stores the numbers N1 and N2.

When the notice signal providing unit 200*c* generates the notice signal to send it to the display 210, a notice message is displayed on the display 210. When a switching operation is performed by the user, the sheet supply area is switched by the sheet supply position switching unit 201.

Figure 16:
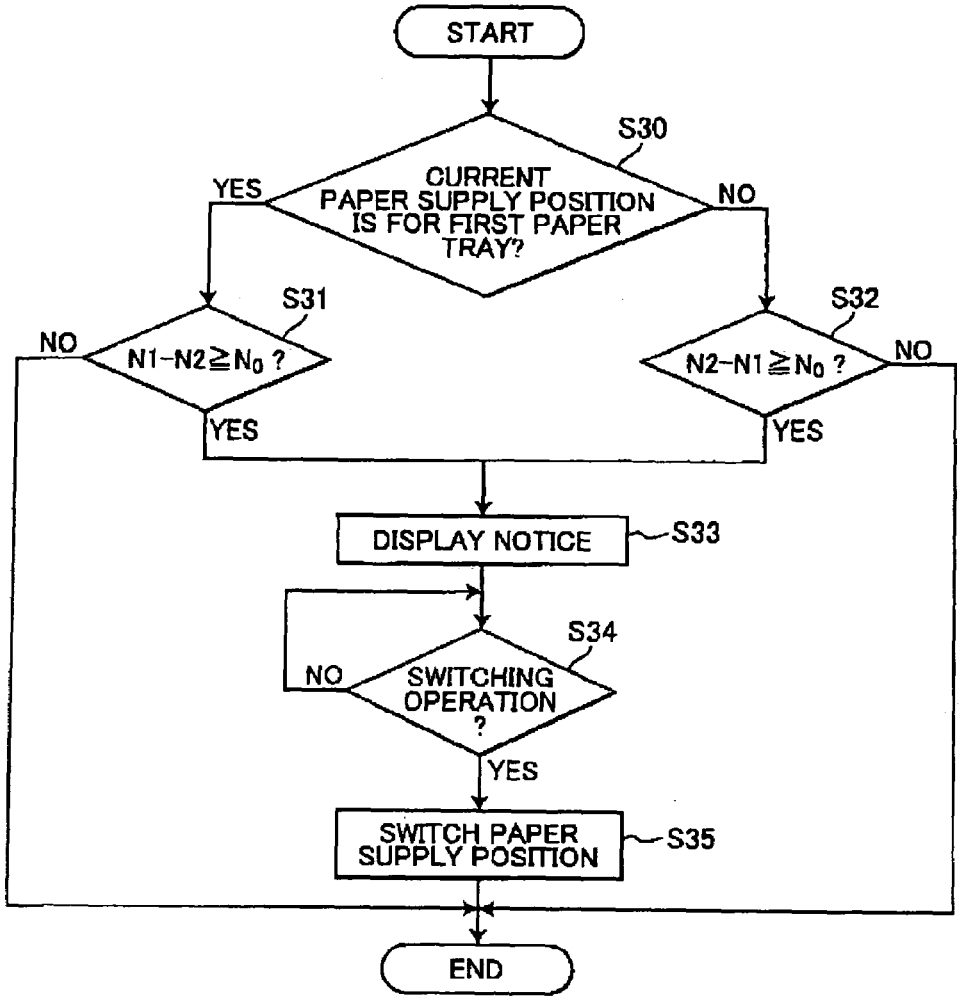
FIG. 16 is a flowchart illustrating a process for issuing a notice to switch the sheet supply area.

The following description will be made for explaining the procedure to generate a notice signal. As shown in FIG. 16, the sheet supply position switching unit 201 determines in S30 whether the current sheet supply position corresponds to the first sheet tray 111. If the current position corresponds to the first sheet tray 111 (S30: YES), then in S31 the sheet supply position switching unit 201 determines whether the value subtracted the number N2 from the number N1 is greater than or equal to a prescribed number $N_0$. If $N1-N2 \geqq N_0$ (S31: YES), then the sheet supply position switching unit 201 determines that the number of sheets printed at the first printing area P1 (see FIG. 10) is greater than the number of sheets printed at the second printing area P2 by at least the prescribed number $N_0$ and then advances to S33. Similarly, if the sheet supply position switching unit 201 determines in S30 that the current sheet supply position corresponds to the second sheet tray 112 (S30: NO), then in S32 the sheet supply position switching unit 201 determines whether a value subtracted the number N1 from the number N2 is greater than or equal to the prescribed number $N_0$. If $N2-N1 \geqq N_0$ (S32: YES), then the sheet supply position switching unit 201 determines that the number of sheets printed at the second printing area P2 is greater than the number of sheets printed at the first printing area P1 by the prescribed number No and then advances to S33.

In S33 a notice signal is transmitted from the notice signal providing unit 200*c* to the display 210, and a notice message is displayed on the display 210 to prompt the user to switch the sheet supply area. Subsequently, the sheet supply position switching unit 201 determines if the user has switched the sheet supply area through a control panel 211 based on a signal that indicates that the switching operation has been performed. When the sheet supply position switching unit 201 determines that the user has operated through the control panel 211 (S34: YES), then in S35 the sheet supply position switching unit 201 switches the sheet supply position. When the sheet supply position switching unit 201 determines that the user has not operated yet (S34: NO), the sheet supply position switching unit 201 maintain waiting for the user's operation.

The process to notice the user of a necessity to switch sheet supply areas has a lot of styles such as displaying a notice message on the display 210, producing an alarm sound, or turning or, flashing a notice lamp. Alternatively, the notice message can be displayed on a display connected to a personal computer by transmitting the notice signal from the notice signal providing unit 200*c* to a print data input device in the personal computer.

Next, an inkjet printer according to a second embodiment will be described. The second embodiment differs from the first embodiment in that the sheet supply position is switched after a prescribed time period has been elapsed since the power is turned on to an inkjet printer (see FIG. 10). Here, parts and components having substantially the same structure described in the first embodiment are designated by the same reference numerals to avoid duplicating description.

Figure 17:
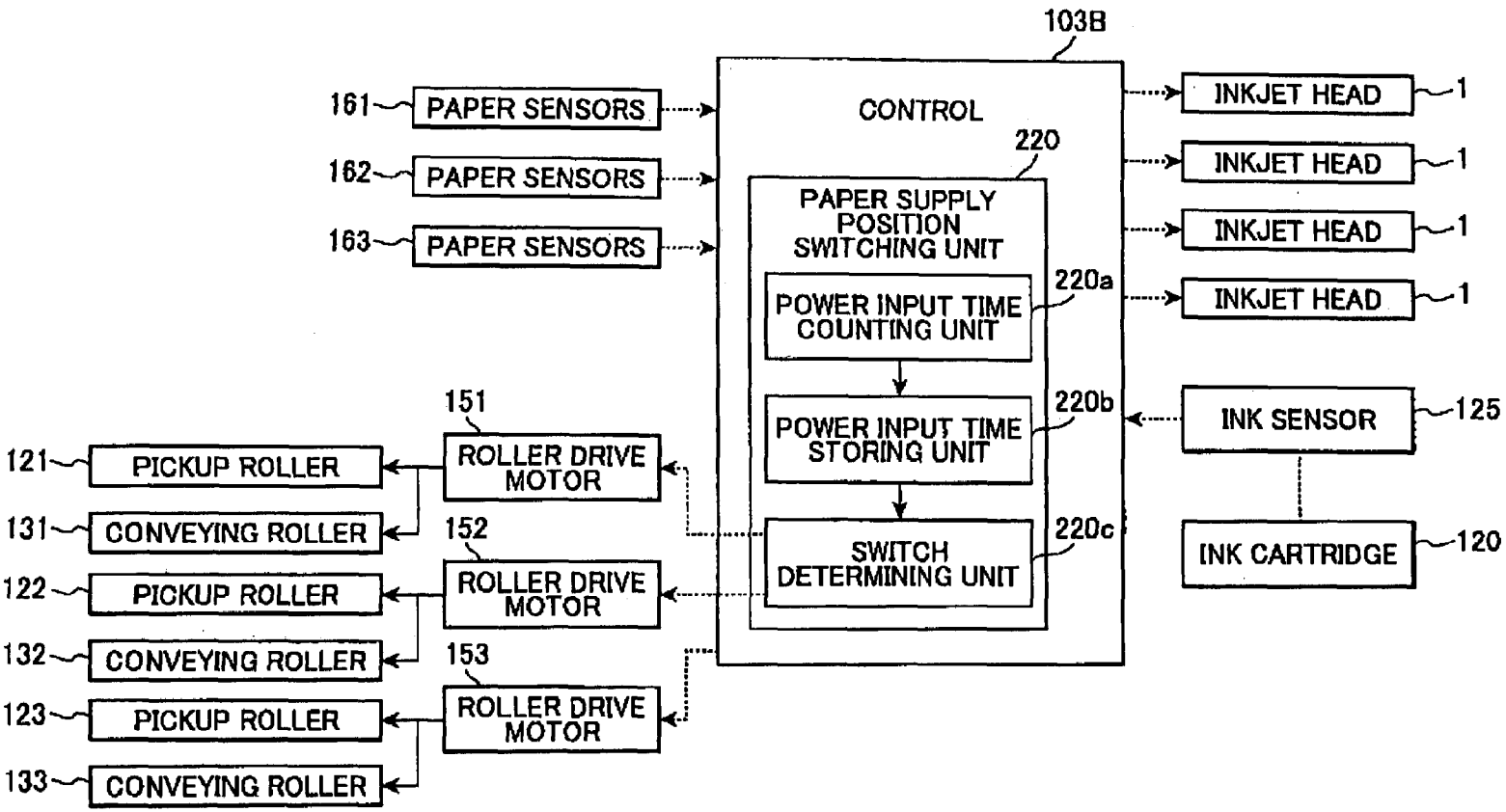
FIG. 17 is a block diagram showing a control system of an inkjet printer according to a second embodiment of the is present invention.

As shown in FIG. 17, a controller 103B is provided with a sheet supply position switching unit 220. The sheet supply position switching unit 220 includes a power input time measuring unit 220*a*, a power input time storing unit 220*b*, and a switch determining unit 220*c*. The power input time measuring unit 220*a* measures a power input time T since the sheet supply position is switched to one of the printing areas P1 and P2. The power input time storing unit 220*b* stores the power input time T measured by the power input time measuring unit 220*a*. The switch determining unit 220*c* determines whether to switch the sheet supply position based on the power input time T stored in the power input time storing unit 220*b*.

The power input time T is an elapsed time in which the power has been supplied to the printer 101 after the sheet supply position is switched. The power input time counting unit 220*a* maintains measuring the power input time T at prescribed periods. The measured power input time T is stored in the power input time storing unit 220*b*. For example, the power input time storing unit 220*b* is configured of a rewritable memory such as EEPROM.

Figure 18:
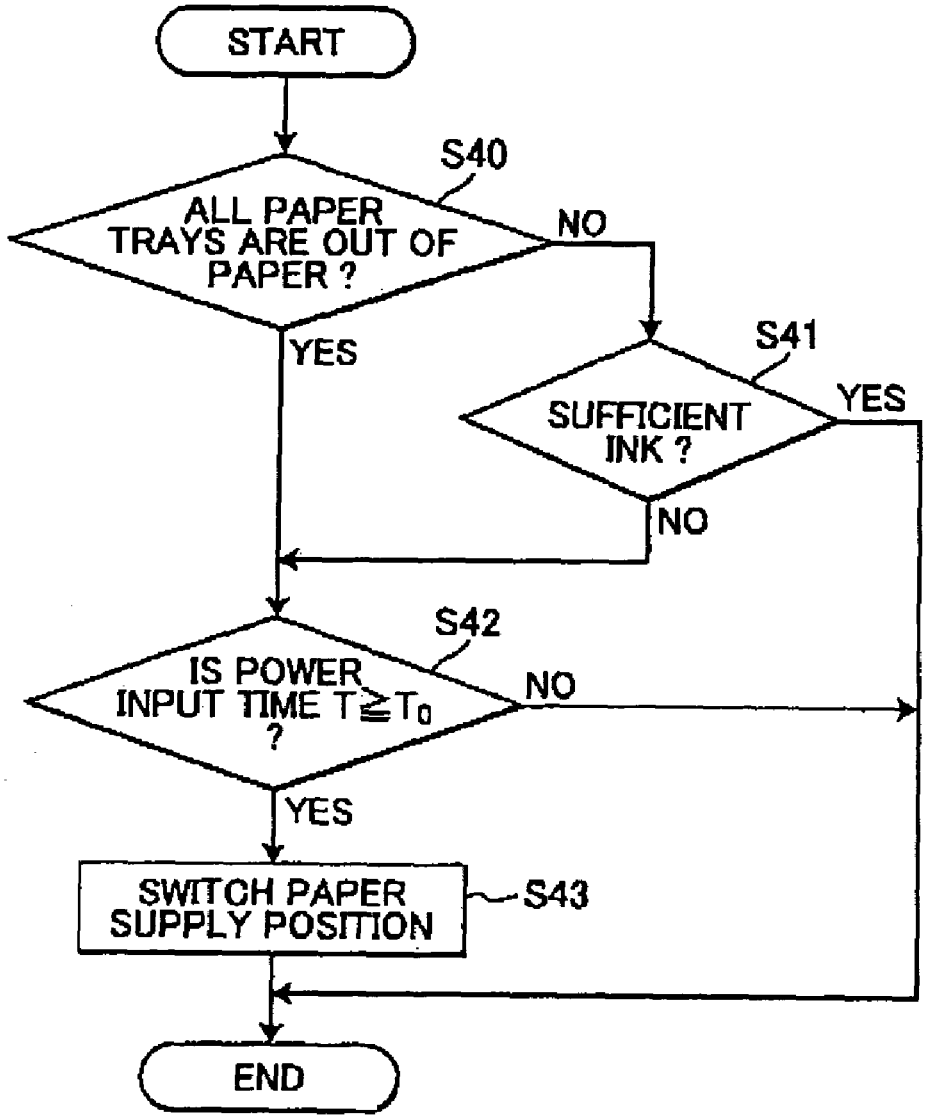
FIG. 18 is a flowchart illustrating steps in a process for determining whether to switch the sheet supply area.

Next, the switch determining unit 220*c* determines whether to switch the sheet supply position. The switch determining unit 220*c* performs a procedure as shown in FIG. 18. Specifically, if the switch determining unit 220*c* determines in S40 that all of the sheet trays 111-113 are out of sheet based on output signals from the sheet sensors 161-163 (S40: YES), the inkjet head 1 is incapable of printing. Then, the procedure goes to 542.

if the switch determining unit 220c determines in S40 that any one of the sheet trays 111-113 has one or more sheets based on output signals from the sheet sensors 161-163 (S40: NO), the switch determining unit 220c then determines in S41 whether the ink cartridge 120 includes sufficient ink based on an output signal from the ink sensor 125. In S41, if the ink cartridge does not include sufficient ink (S41; NO), then the inkjet head 1 is incapable of printing and the procedure goes to S42. If the ink cartridge includes sufficient ink (S41: YES), the procedure goes to END.

In S42, the switch determining unit 220c determines whether the power input time T is greater than or equal to a prescribed time $T_0$. If the power input time T is greater than or equal to the prescribed time To (S42: YES), then the switch determining unit 220c determines that the number of printing operations at the printing area corresponding to the current sheet supply tray has become greater than that of the other printing area, and goes to S43. In S43 the switch determining unit 220c switches the sheet supply tray to the other sheet supply tray. If the power input time T is less than the prescribed time $T_0$ (S42: NO), the procedure goes to END.

When the user loads new sheets in the first sheet tray 111 and second sheet tray 112 or replaces the empty ink cartridge with a new ink cartridge 120, and the inkjet head 1 is set to be capable of printing on the sheet, the sheet is supplied to the inkjet heads 1 to be printed from the new sheet supply position.

The inkjet printer 101 of the second embodiment is configured to switch one of the sheet supply trays to the other when the power input time T becomes greater than or equal to the prescribed time $T_0$ after a switching to the one of the sheet supply trays. Alternatively, the time measuring unit 220a can accumulatively measure a power input time T during which each of the sheet supply positions is used for feeding a sheet. The switch determining unit 220c then subtracts the previous, power input time T2 for the printing area P2 from the current power input time T1 for the printing area P1, for example. According to the difference time between the power input times T1, T2, the switch determining unit 220c can switch the printing areas P1 and P2.

The inkjet printer according to the second embodiment exhibits the same advantages as those of the first embodiment. The inkjet printer does not need the feeding sensors 171 and 172 used in the first embodiment for counting the number of supplied sheets.

Next, an inkjet printer according to a third embodiment of the present invention will be described. The third embodiment differs from the first embodiment in that the sheet supply position is switched based on the number of moments (i.e., timings) at which a drive signal is applied to the electrode 35 (see FIG. 8) in the printing areas P1 and P2. Here, parts and components having a similar construction as those described in the first embodiment are designated by the same reference numerals to avoid duplicating description.

Figure 19:
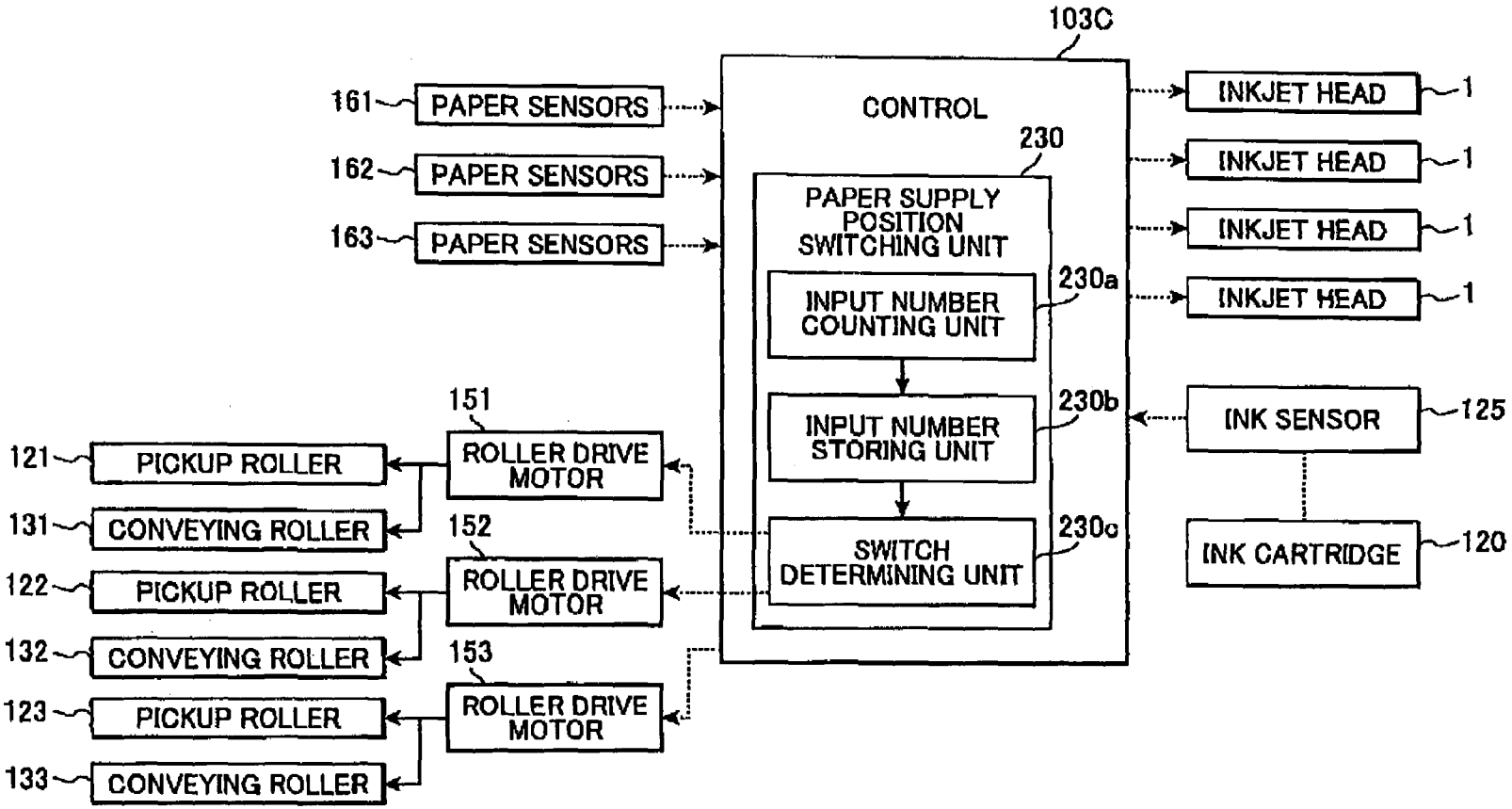
FIG. 19 is a block diagram showing a control system of an inkjet printer according to a third embodiment of the present invention.

As shown in FIG. 19, a controller 103C is provided with a sheet supply position switching unit 230. The sheet supply position switching unit 230 includes an input number counting unit 230a, an input number storing unit 230b, and a switch determining unit 230c. The input number counting unit 230a counts a timing at which a drive signal is applied to the electrodes 35 in each of the printing areas P1 and P2 The input number storing unit 230b stores an output of the input number counting unit 230a, i.e., the value of timings counted by the input number counting unit 230a. The switch determining unit 230c determines whether to switch the sheet supply position based on the values stored in the input number storing unit 230b.

Figure 20:
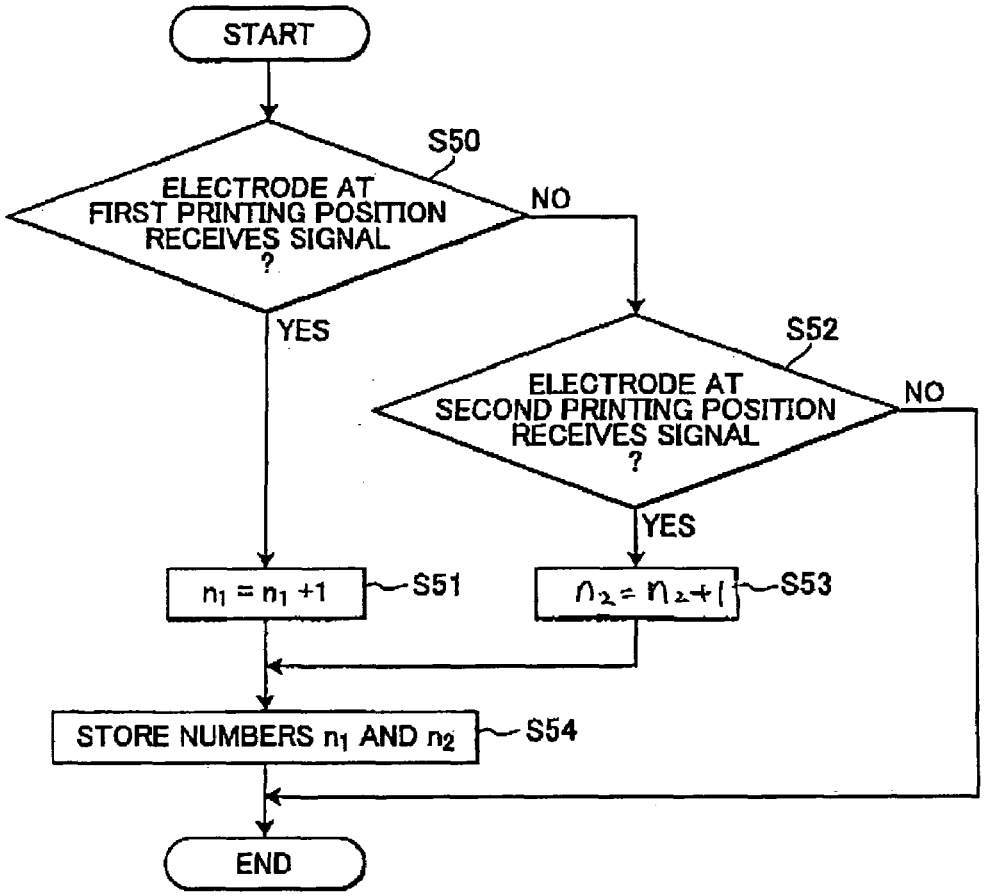
FIG. 20 is a flowchart illustrating a process for counting the number of timings at which a drive signal is applied.

Referring to FIG. 20, when a drive signal is applied to the electrode 35 at the first printing area P1 corresponding to the first sheet tray 111 (S50: YES), in S51 the input number counting unit 230a increments a value of drive signal $n_1$ applied to the first printing area P1 by one.

If the drive signal is not applied to the electrode 35 at the first printing area P1 (S50: NO), the procedure goes to S52. In S52, when a drive signal is applied to the electrode 35 in the second printing area P2 corresponding to the second sheet tray 112 (S52: YES), in S53 the input number counting unit 230a increments a value of drive signal $n_2$ applied to the second printing area P2 by one. In S54 the values of $n_1$ and $n_2$ are stored in the input number storing unit 230b. The input number storing unit 230b is configured of a rewritable memory, such as EEPROM. After S54, the procedure goes to END.

In S50 and S52 the sheet supply position switching unit 230 can determine that a drive signal has been applied to the printing areas P1 and P2 by determining whether a drive signal has been applied onto one of the electrodes 35 representing the printing area, for example. The sheet supply position switching unit 230 may also employ a plurality of electrodes 35 to represent the printing area and determine when the drive signals are applied onto a prescribed number of electrodes 35 among the plurality of electrodes 35.

Alternatively, the sheet supply position switching unit 230 may use a simple average or weighted average of the number of timings at which drive signals are applied to some of the plurality of electrodes 35 representing the printing area as the number of timings at which the drive signals are applied to the printing areas P1 and P2.

Figure 21:
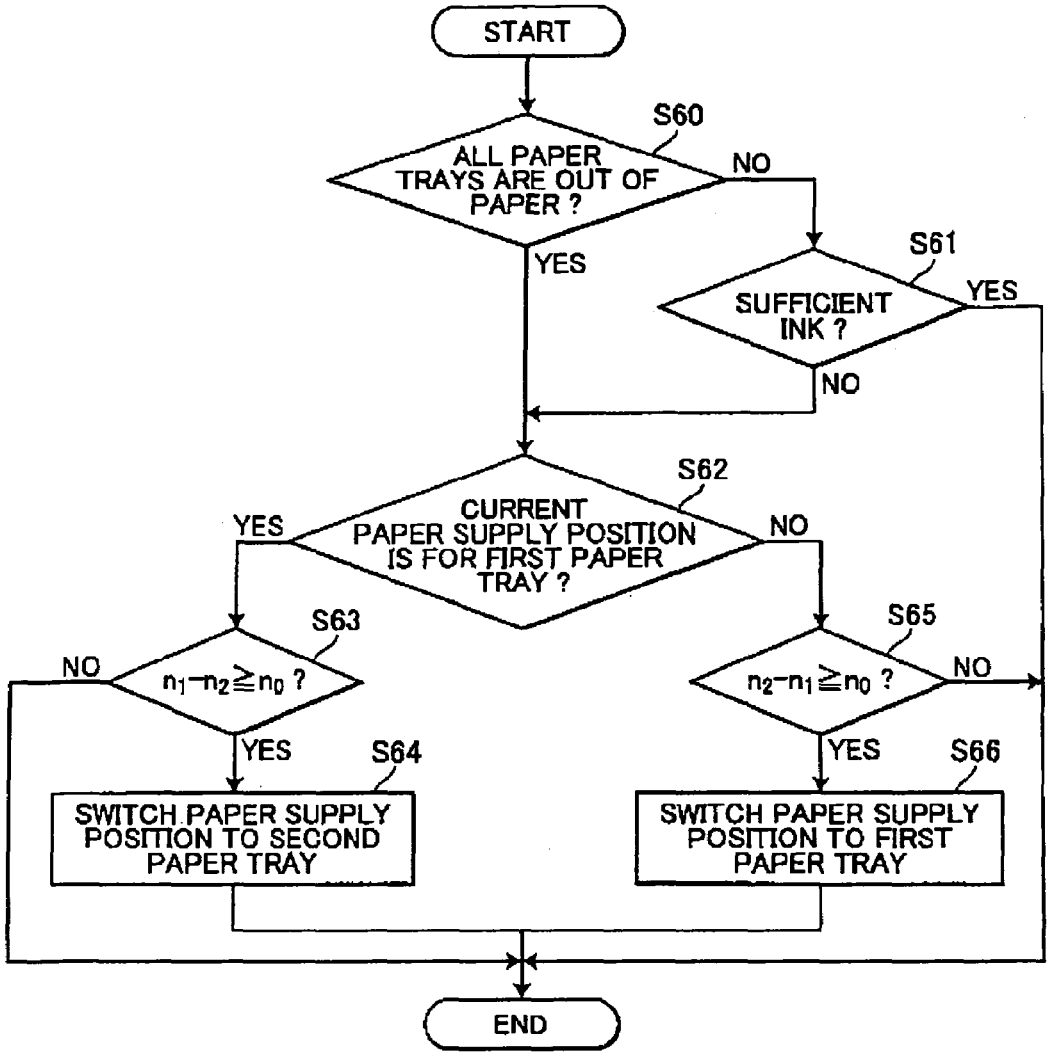
FIG. 21 is a flowchart illustrating a process for determining whether to switch the sheet supply area.

Next, the switch determining unit 230c determines whether to switch the sheet supply position, as illustrated in FIG. 21. As described in the first embodiment, if the switch determining unit 230c determines that no sheet remains in the three sheet trays 111-113 based on output signals from the sheet sensors 161-163 (S60: YES), or determines that the ink cartridge 120 does not include, sufficient ink based on an output of the ink sensor 125 (S61: NO), it means that the inkjet head 1 is incapable of printing. Then the switch determining unit 230c determines whether or not to switch the sheet supply position in the steps following S62.

Specifically, in S62 the switch determining unit 230c determines whether the current sheet supply position is the first sheet tray 111. If the current position is the first sheet tray 111 (S62: YES), then in S63 the switch determining unit 230c determines whether a value subtracted the number $n_2$ from the number $n_1$ is greater than or equal to a prescribed number $n_0$. If $n_1-n_2 \geqq n_0$ (S63: YES), then in S64 the switch determining unit 230c switches the sheet supply position from the first sheet tray 111 to the second sheet tray 112.

On the other hand, if the switch determining unit 230c determines that the current sheet supply position is the second sheet tray 112 (362: NO), then in S65 the switch determining unit 230c determines whether a value subtracted the number $n_1$ from the number $n_2$ is greater than or equal to the prescribed number no. If $n_2-n_1 \geqq n_0$ (S65: YES), then in S66 the switch determining unit 230c switches the sheet supply position from the second sheet tray 112 to the first sheet tray 111.

In a modification of the third embodiment, the input number counting unit 230a can reset in response to switching printing areas P1 and P2, and then start counting a timing at which the drive signal is applied to the electrodes 35 in each of the printing areas P1 and P2. In this case, when the number of timings at which the driving signal is applied in the printing area P1 reaches or exceeds a prescribed number, for example, the switch determining unit 230*c* determines that the sheet supply position should be switched, and then switches the sheet supply position to the other for the printing area P2.

The inkjet printer according to the third embodiment exhibits the same advantages as those of the first embodiment, and also eliminates the sheet supply sensors employed to count the number of supplied sheets, as described in the second embodiment.

Figure 22A:
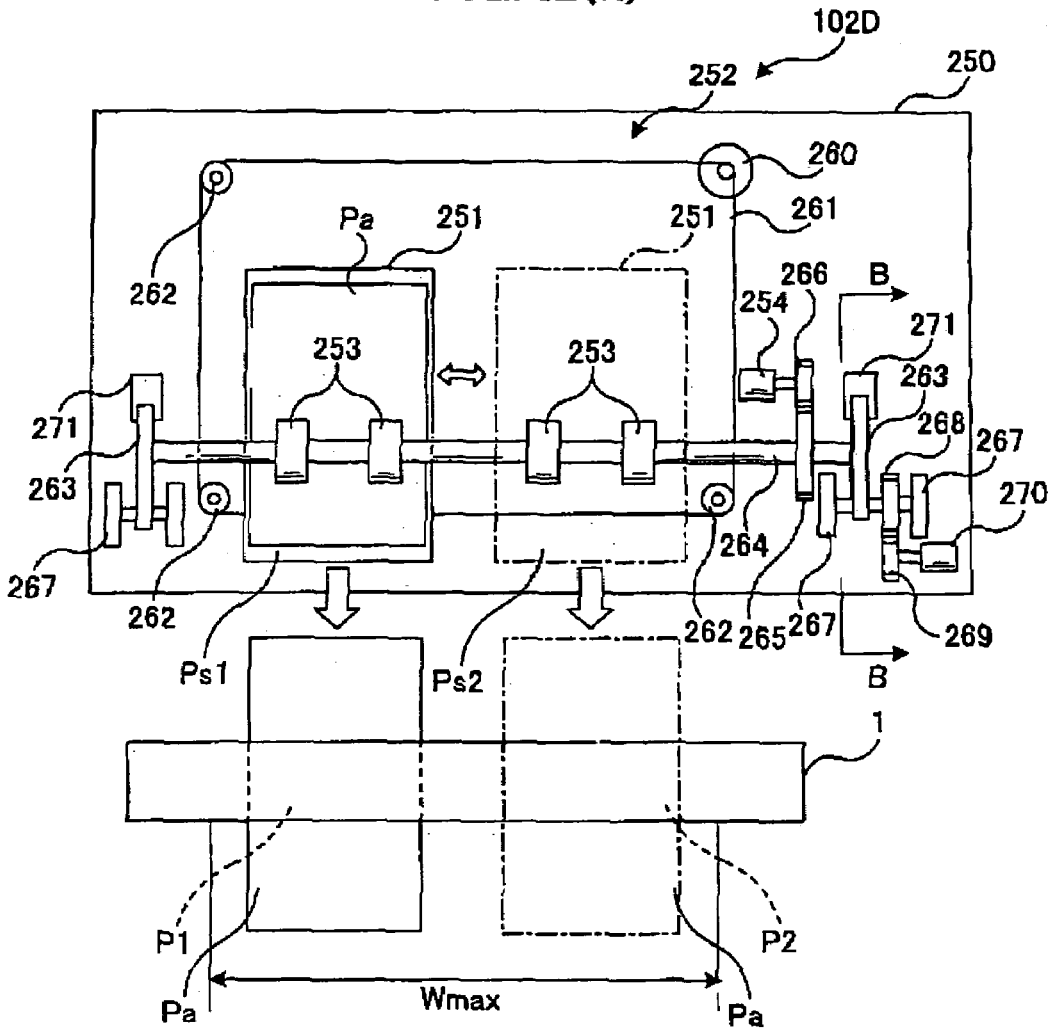
FIG. 22(*a*) is a schematic diagram showing a sheet supply mechanism of an inkjet printer according to a fourth embodiment of the present invention, FIG. 22(*b*) is a cross-sectional view taken along lines of B-B in FIG. 22(*a*)
Figure 22B:
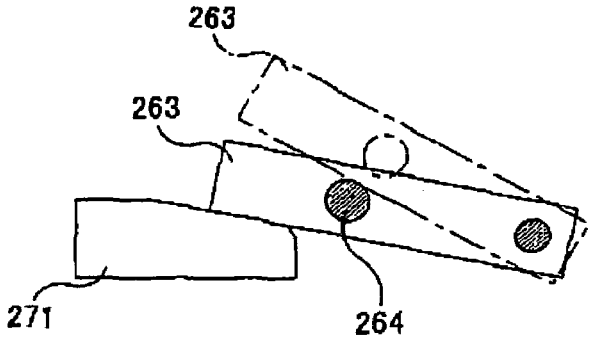

Next, an inkjet printer according to a fourth embodiment of the present invention will be described. Referring to FIG. 22, the inkjet printer 101 includes a sheet supply mechanism 102D. The sheet supply mechanism 102D includes a sheet supply tray 251 for accommodating a sheet Pa having the width which is narrower than the maximum printable width Wmax of the inkjet head 1. The sheet supply mechanism 102D is configured to switch the sheet supply position by moving the sheet supply tray 251 between one of two sheet supply positions Ps1 and Ps2 that are offset in the widthwise direction of the sheet.

As shown in FIG. 22, the sheet supply mechanism 102D includes a tray accommodating case 250, the sheet supply tray 251, a tray driving mechanism 252, and a roller drive motor 254. The tray accommodating case 250 is detachably mounted in a casing (not shown) of the inkjet printer 101. The sheet supply tray 251 is disposed in the tray accommodating case 250 for accommodating the sheet Pa having a narrower width than the maximum printable width Wmax of the inkjet head 1. The tray driving mechanism 252 moves the sheet supply tray 251 in the widthwise direction of the sheet. The pickup rollers 253 feed the sheet Pa accommodated in the sheet supply tray 251 one sheet at a time. The roller drive motor 254 drives the pickup rollers 253 to rotate.

The sheet supply tray 251 can be moved reciprocatingly between the sheet supply positions Ps1 and Ps2 at positions offset in the widthwise direction of the sheet (left-to-right direction in FIG. 22). The tray driving mechanism 252 includes a tray drive motor 260, and a wire 261 for transferring the driving force of the tray drive motor 260 to the sheet supply tray 251. The wire 261 is coupled to the sheet supply tray 251 at both widthwise edges and is further coupled with the tray drive motor 260 via three pulleys 262. Hence, the driving force of the tray drive motor 260 is transferred to the sheet supply tray 251 via the wire 261, causing the sheet supply tray 251 to move reciprocatingly in the widthwise direction of the sheet. The sheet supply tray 251 can be moved between the sheet supply positions Ps1 and Ps2 offset in the widthwise direction by the proper amount by controlling the rotational angle of the tray drive motor 260, for example.

Alternatively, a tray sensor may be disposed at the sheet supply positions Ps1 and Ps2 for detecting that the sheet supply tray 251 is placed at either one of the sheet supply positions Ps1 and Ps2. In this case, the tray drive motor 260 may move the sheet supply tray 251 until the sheet supply tray 251 is detected by the tray sensor. While not illustrated in the drawing, it is preferable to provide a mechanism for guiding movement of the sheet supply tray 251 in the widthwise direction of the sheet. Accordingly, the sheet supply tray 251 can be moved smoothly when the sheet supply positions is switched.

The pickup rollers 253 are aligned in the widthwise direction at two positions for each of the sheet supply positions Ps1 and Ps2. The pickup rollers 253 are fixed to a roller shaft 264 pivotably supported in brackets 263 provided one at each end. A gear 265 is fixed to the roller shaft 264. The gear 265 is engaged with a small gear 266 coupled with the roller drive motor 254. Accordingly, the driving force of the roller drive motor 254 is transferred to the roller shaft 264 via the gears 265 and 266 for rotating the four pickup rollers 253. The two pickup rollers 253 are disposed at the positions corresponding to the sheet supply position at which the sheet supply tray 251 is located. The two pickup rollers 253 feed the sheet Pa accommodated in the sheet supply tray 251 one sheet at a time.

When the sheet supply tray 251 is moved in the widthwise direction of the sheet, the pickup rollers 253 are configured to draw upward away from the sheet pickup position. At this moment, the pickup rollers 253 do not interfere with the sheet supply tray 251. Specifically, the two brackets 263 pivotably support both ends of the roller shaft 264 and freely pivot about bearings 267.

A drive motor 270 is coupled to one of the brackets 263 via two gears 268 and 269. Accordingly, the driving force of the drive motor 270 is transferred to the brackets 263 via the gears 268 and 269, causing the brackets 263 and roller shaft 264 to rotate integrally in the clockwise direction of FIG. 22(*b*). Stoppers 271 are disposed under each of the brackets 263. When the pickup rollers 253 feed the sheet Pa, the brackets 263 contact and rest on the stoppers 271. Therefore, the positions of the pickup rollers 253 are appropriately set for picking up the sheet Pa.

As in the first through third embodiments described above, the inkjet printer of the fourth embodiment switches the sheet supply position for supplying the sheet Pa between the sheet supply positions Ps1 and Ps2 based on the number of printing operations at the printing areas P1 and P2 of the inkjet head 1 corresponding to the sheet supply positions Ps1 and Ps2. More specifically, based on instructions from the sheet supply position switching unit 115 (see FIG. 11), the drive motor 270 rotates. And the driving force of the drive motor 270 is transferred to the roller shaft 264, causing the roller shaft 264 and pickup rollers 253 to withdraw upward as a unit.

Next, the tray drive motor 260 rotates and the driving force of the tray drive motor 260 is transferred to the sheet supply tray 251 via the wire 261, causing the sheet supply tray 251 to move in the widthwise direction of the sheet to switch the sheet supply position. The operations of the sheet supply position switching unit 115 are identical to those described in the first through third embodiments. Therefore, a description of these operations has been omitted here.

Figure 23:
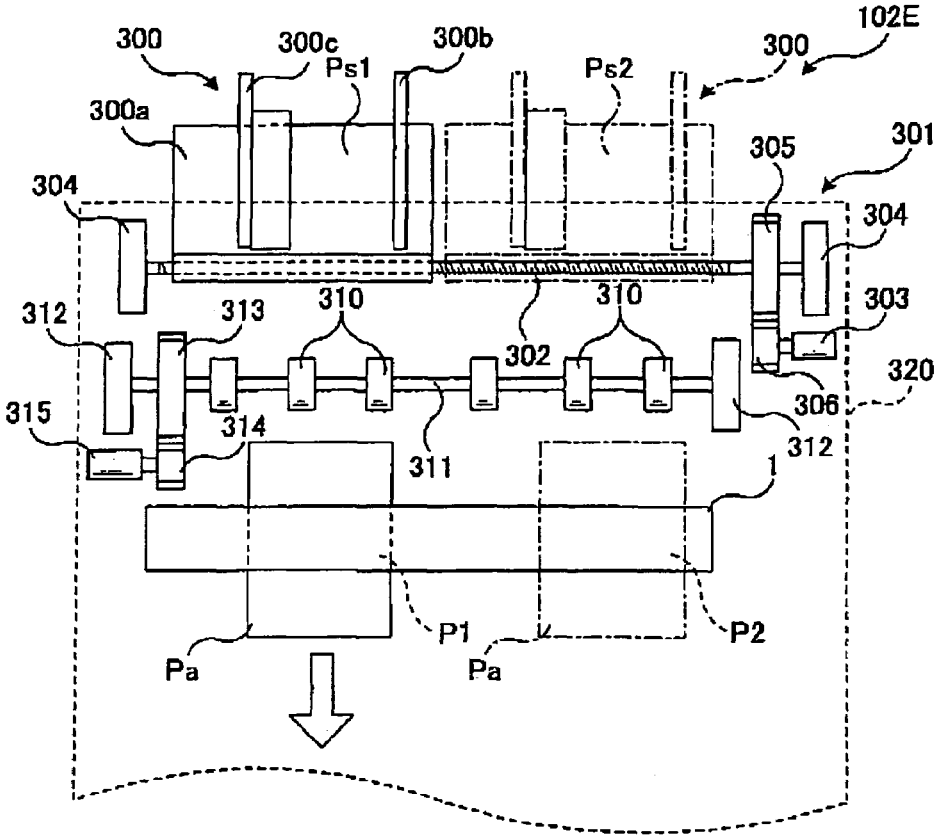
FIG. 23 is a schematic diagram showing a sheet supply mechanism of an inkjet printer according to a fifth embodiment of the present invention.

Next, an inkjet printer according to a fifth embodiment of the present invention will be described. Referring to FIG. 23, the inkjet printer 101 includes a sheet supply mechanism 102E. The sheet supply mechanism 102E includes a hand-feed tray 300 in which the sheet Pa having the width narrower than the maximum printable width Wmax of the inkjet head 1 can be manually inserted.

The sheet supply mechanism 102E is configured to switch the sheet supply position of the inkjet printer by moving the hand-feed tray 300 between a sheet supply position Ps1 and sheet supply position Ps2 offset in the widthwise direction of the sheet. The hand-feed tray 300 is placed in a casing 320 of the inkjet printer, and is capable of moving in the widthwise direction of the sheet. In addition to the hand-feed tray 300, the sheet supply mechanism 102E is provided with a tray driving mechanism 301 for moving the hand-feed tray 300 in the widthwise direction.

The hand-feed tray 300 includes a tray case 300*a* on which the sheet Pa is placed, a sheet position determining plate 300*b* fixed to the tray case 300*a*, and a sheet guide 300*c* that moves relative to the sheet position determining plate 300*b* in the widthwise direction. The user can set sheet of a desired width between the sheet position determining plate 300*b* and sheet guide 300*c* by moving the sheet guide 300*c* to a desired position. The tray driving mechanism 301 is configured to, move the hand-feed tray 300 between the sheet supply positions Ps1 and Ps2 at positions offset in the widthwise direction of the sheet (left-to-right direction in FIG. 23). The tray driving mechanism 301 includes a feed screw shaft 302 that is screwed into the tray case 300*a*, and a tray drive motor 303 coupled with the feed screw shaft 302. The feed screw shaft 302 is pivotably supported by bearings 304 disposed on both ends thereof. The tray drive motor 303 is coupled to the feed screw shaft 302 via two gears 305 and 306. Accordingly, the driving force of the tray drive motor 303 is transferred to the feed screw shaft 302, causing the feed screw shaft 302 to rotate to move the hand-feed tray 300 in the widthwise direction in the casing 320.

Six conveying rollers 310 are arranged in the widthwise direction for conveying the sheet Pa set in the hand-feed tray 300 to the inkjet head 1. The conveying rollers 310 are fixed to a roller shaft 311. The roller shaft 311 is rotatably supported on both ends by bearings 312. The roller shaft 311 is also coupled to a roller drive motor 315 via gears 313 and 314. The six conveying rollers 310 are arranged in the widthwise direction of the sheet, with two of the conveying rollers 310 disposed at positions corresponding to both the sheet supply positions Ps1 and Ps2.

As described in the first through third embodiments, the sheet supply position for supplying the sheet Pa is switched between the sheet supply positions Ps1 and Ps2 based on the numbers of printing operations at each of the printing areas P1 and P2 corresponding to the sheet supply positions Ps1 and Ps2. Specifically, by commands from the sheet supply position switching unit 115 (see FIG. 11), the tray drive motor 303 rotates and the driving force of the tray drive motor 303 is transferred to the feed screw shaft 302, causing the hand-feed tray 300 to move in the widthwise direction of the sheet through the rotations of the feed screw shaft 302 to switch the sheet supply position. At this time, the sheet supply position switching unit 115 controls the rotational angle of the tray drive motor 303 and stops the hand-feed tray 300 at the prescribed sheet supply position. Alternatively, tray sensors such as limit switches may be provided at position corresponding to the printing areas P1 and P2 for detecting when the sheet supply tray has moved to each sheet supply position. Subsequently, the roller drive motor 315 rotates the conveying rollers 310, and the conveying rollers 310 convey the sheet Pa from the new sheet supply position to the corresponding printing area of the inkjet head 1. The sheet Pa then undergoes a printing process at that printing area. The operations of the sheet supply position switching unit 115 are identical to those described in the first through third embodiments. Therefore, a description of these operations has been omitted.

In the first through fifth embodiments described above, the sheet supply position for supplying sheet in the inkjet head 1 is selectively switched between two positions. However, the number of sheet supply positions (number of printing areas) is not limited to two in the present invention. Depending on various conditions, including the maximum printable width and the sheet width, the sheet supply position may be selectively switched among three or more positions.

The sheet supplied by the sheet supplying mechanism may be a standard size, such as A4 and B5, or a nonstandard size. When printing on nonstandard size sheet, the user has to input the sheet size (sheet width) via an input device such as a personal computer connected to the inkjet printer. As described in the fourth and fifth embodiments, the process to move the sheet tray in the widthwise direction to switch the sheet supply position may be implemented by receiving data related on the width of the non standard sheet via the input device, controlling the rotational angle of the tray drive motor for switching the sheet supply position based on the receive data, and moving the, sheet tray to a prescribed sheet supply position.

The present invention can also be applied to an inkjet printer capable of printing on roll sheet that has been cut to a prescribed length by a cutter just prior to printing. For example, the inkjet printer may be configured to switch the sheet supply position of the roll sheet by integrally moving the holder maintaining the roll sheet and the cutter for cutting the roll sheet based on printing frequencies at a plurality of printing areas.

In the preferred embodiments described above, the sheet supply mechanism can selectively supply sheet from a plurality of sheet supply positions with respect to the inkjet head, and switches the sheet supply position based on the number of printing operations at each of a plurality of printing areas. Alternatively, the sheet supply mechanism can be fixed at a single sheet supply position. And the inkjet head can be moved in relation to the sheet supply mechanism in the widthwise direction of the sheet supplied from the sheet supply mechanism and be switched between a plurality of printing areas for printing on sheet supplied from the sheet supply mechanism.

With the above types of inkjet printer, a sheet having a width narrower than the maximum printable length of the inkjet head is selectively, supplied by the sheet supply mechanism to one of a plurality of printing areas shifted from each other in the width direction of the sheet. At this time, the printing area switching unit switches the printing area based on the number of printing at each of the plurality of printing areas. Since the printing area to be supplied by the sheet is switched to another area when the number of printing at the current printing area becomes too high, the present invention prevents the nozzles from being too frequently used in specific regions and avoids local deterioration of various printing components and mechanisms, such as the actuator used for ejecting ink through the nozzles, and the sheet supplying mechanism. Further, when later printing on a wider sheet, there are no local areas with inferior printing quality, ensuring a high overall printing quality.

With this inkjet printer, the sheet supply mechanism selectively supplies sheet that is narrower than the maximum printable width of the inkjet head from a plurality of sheet supply areas corresponding to the plurality of printing areas that are offset from each other in the widthwise direction of the sheet. At this time, the sheet supply position switching unit switches the sheet supply area among a plurality of positions based on the number of printing at each of the plurality of printing areas. Therefore, when the number of printing at a certain printing area becomes high, the sheet supply area is switched to a position corresponding to another printing area. And a sheet is supplied to this new printing area by the sheet supply mechanism. Accordingly, the present invention prevents the nozzles from being too frequently used in specific regions and avoids local deterioration of various printing components and mechanisms, such as the actuator used for ejecting ink through the nozzles, and the sheet supplying mechanism. Further, when later printing on a wider sheet, there are no local areas with inferior printing quality, ensuring a high overall printing quality.

By selectively switching the sheet supply area among a plurality of areas corresponding to the plurality of printing areas, the number of sheets supplied from a certain sheet supply area does not become exceedingly larger than that from another sheet supply area, thereby preventing local deterioration and wear on components constituting the sheet supply mechanism, such as sheet rollers and conveying belts, and extending the life of these components.

With this line printer, a long inkjet head is fixed in a direction orthogonal to the sheet supply direction. Accordingly, if the inkjet head prints on a sheet narrower than the maximum printable width of the head at the same printing area, the number of ejection for nozzles in this position will increase dramatically resulting in a local deterioration in ejection precision. Therefore, the sheet supply position switching means switches the sheet supply area among a plurality of positions based on the printing frequencies at the plurality of printing areas, thereby preventing the frequency of nozzle ejection in a particular area from becoming too high.

Since there are no nozzles that must eject ink at both printing areas when the printing area is switched, it is possible to prevent a dramatic increase in nozzle ejection frequency more reliably in a specific area.

When printing is made on a sheet narrower than the maximum printable width at two printing areas whose printing areas do not overlap and whose positions abut the widthwise ends of the total printing area, the number of printing in the center of the total printing area is lower than that at the ends of the printing area. Accordingly, the widthwise center of the total printing region of the inkjet head has little decline in ink ejection precision. Therefore, for later printing on wider sheet, a relatively good printing quality can be achieved in the widthwise center of the sheet, which is the most noticeable area.

When printing is made on a sheet narrower than the maximum printable width at two printing areas which do not overlap and whose positions abut both sides of a centerline running through the total printing area of the inkjet head in the sheet supplying direction, borders between areas for printing on narrow sheet at the printing area and areas that are not printed, that is, borders between areas with the different number of printing are positioned in both widthwise sides of the total printing area. Hence, a difference in printing quality caused by the difference in usage frequency appears at these borders between areas of different printing frequencies. However, in later printing on a wider sheet, these borders are not very noticeable because the borders are positioned away from the center of the wide sheet in areas that are not particularly noticeable The inkjet printer of the above embodiments prevents a decline in printing quality that may occur when switching the sheet supply area while performing a printing process.

Accordingly, the inkjet printer of the above embodiments prevents the sheet supply area from being switched during a printing operation when the printer is capable of printing.

When the number of printing at a certain printing area becomes high, rollers feed a sheet from a sheet supply tray corresponding to a different printing area, thereby preventing a large increase in the usage of nozzles in a specific range and preventing a local decline in printing quality for printing on a wider sheet.

When the number of printing at a certain printing area becomes high, the sheet supply tray is moved to a sheet supply area corresponding to a different printing area, and sheet is supplied from the new sheet supply area to the different printing area, thereby preventing a large increase in the usage of nozzles in a specific area and preventing a local decline in printing quality for printing on a wider sheet.

When the number of printing at the current printing area exceeds the number of printing at another printing area by a prescribed number or greater, the inkjet printer determines that the number of printing is sufficiently higher than that of the other printing area and switches the sheet supply area, thereby preventing a large increase in the usage number of nozzles in a specific area and preventing a local decline in printing quality for printing on a wider sheet.

When the power input time at the current printing area exceeds the power input time at another printing area by a prescribed time or greater, the inkjet printer determines that the number of printing at one printing area is sufficiently higher than that of the other printing area and switches the sheet supply, area, thereby preventing a large increase in the usage number of nozzles in a specific range and preventing a local decline in printing quality for printing on a wider sheet.

When the number of timing at which a drive signal is applied to electrodes at the current printing area exceeds the number of timings at which a drive signal is applied to electrodes at another printing area by a prescribed number or greater, the inkjet printer determines that the number of printing is sufficiently higher than that of the other printing area and then switches the sheet supply area, thereby preventing a large increase in the usage frequency of nozzles in a specific range and preventing a local decline in printing quality for printing on a wider sheet.

The inkjet printer can easily determine when the number of printing at one printing area is sufficiently higher than that of another printing area by determining the number of timings at which a drive signal is applied to each of the plurality of printing areas. The number of timings at which a drive signal is applied to one or plural of electrodes representing the plurality of electrodes corresponding to the printing area.

When the number of printing at the current printing area becomes high in the inkjet printer, the notice signal generating unit generates a notice signal indicating that the sheet supply area should be switched. The notice signal generating unit then supplies the notice signal to a display to display a notice message thereon. Alternatively, the display notices the user that a sheet supply area should be switched. When the user acknowledges the notice and switches the sheet supply area to another of the plurality of sheet supply areas, the sheet supply mechanism then supplies sheet to the new printing area. Accordingly, the usage number of specific nozzles does not increase dramatically, and there is no local deterioration of the various components or mechanisms involved in printing, such as the actuator unit for ejecting ink through the nozzles and the sheet supply mechanism.

After receiving a notice prompt to switch the sheet supply area, the user performs an operation to switch the sheet supply area. When the controller detects the user's input to switch the sheet supply area, the sheet supply area switching means switches the sheet supply area.

What is claimed is:

1. An inkjet printer, comprising:

an inkjet head that prints on a sheet, the inkjet head having a maximum printable length in a width direction crossing a feeding direction of the sheet, the inkjet head having a plurality of printing portions, each of the plurality of printing portions having a width less than the maximum printable length, the plurality of printing portions being shifted from each other in the width direction;

a sheet supply unit having a plurality of sheet supply portions, where the sheet supply unit selectively feeds a narrow sheet having a width less than the maximum printable length, from one of the plurality of sheet supply portions to one of the plurality of printing portions; and a controller that switches the one of the plurality of printing portions to another of the plurality of printing portions by switching the one of the plurality of sheet supply portions to another of the plurality of sheet supply portions, based on the number of printings on the narrow sheet at each of the plurality of printing portions.

2. The inkjet printer according to claim 1, wherein the sheet supply unit has a plurality of sheet supply portions in a one-to-one correspondence with the plurality of printing portions, the controller switches the one of the plurality of sheet supply portions to another of the plurality of sheet supply portions based on the number of printings on the narrow sheet at each of the plurality of printing portions, thereby switching the one of the plurality of printing portions to another of the plurality of printing portions.

3. An inkjet printer, comprising:

an inkjet head that prints on a sheet, the inkjet head having a maximum printable length in a width direction crossing a feeding direction of the sheet, the inkjet head having a plurality of printing portions, each of the plurality of printing portions having a width less than the maximum printable length, the plurality of printing portions being shifted from each other in the width direction;

a sheet supply unit that selectively feeds a narrow sheet having a width less than the maximum printable length to one of the plurality of printing portions, the sheet supply unit having a plurality of sheet supply portions in a one-to-one correspondence with the plurality of printing portions; and a controller that switches the one of the plurality of printing portions to another of the plurality of printing portions based on the number of printings on the narrow sheet at each of the plurality of printing portions, the controller switches the one of the plurality of sheet supply portions to another of the plurality of sheet supply portions based on the number of printings on the narrow sheet at each of the plurality of printing portions, thereby switching the one of the plurality of printing portions to another of the plurality of printing portions.

4. An inkjet printer, comprising:

an inkjet head that prints on a sheet, the inkjet head having a maximum printable length in a width direction crossing a feeding direction of the sheet, the inkjet head having a plurality of printing portions, each of the plurality of printing portions having a width less than the maximum printable length, the plurality of printing portions being shifted from each other in the width direction;

a sheet supply unit having a plurality of sheet supply portions, the plurality of sheet supply portions corresponding to the plurality of printing portions, respectively, the sheet supply unit feeding a narrow sheet from one of the plurality of sheet supply portions to corresponding one of the plurality of printing portions, the narrow sheet having a width less than the maximum printable length; and a controller that switches the one of the plurality of sheet supply portions to another of the plurality of sheet supply portions based on the number of printings on the narrow sheet at each of the plurality of printing portions.

5. The inkjet printer according to claim 4, wherein the inkjet head is fixed and extends orthogonal to the feeding direction.

6. The inkjet printer according to claim 4, wherein the plurality of printing portions include two printing portions, and the two printing portions do not overlap in the width direction.

7. The inkjet printer according to claim 6, wherein the two printing portions are positioned close to or at both ends of the maximum printable length.

8. The inkjet printer according to claim 6, wherein the two printing portions are positioned on both sides with respect to an imaginary line extending through a center of the maximum printable length, respectively, the two printing portions contact each other through the imaginary line.

9. The inkjet printer according to claim 4, wherein the controller switches the one of the plurality of sheet supply portions in a state in which the inkjet head is unavailable for printing.

10. The inkjet printer according to claim 9, wherein the state is one of a state in which the sheet supply unit is out of sheet and a state in which ink is insufficient to be supplied to the inkjet head.

11. The inkjet printer according to claim 4, wherein the sheet supply unit includes:

a plurality of sheet supply trays provided in a one-to-one correspondence with the plurality of sheet supply portions, the plurality of sheet supply trays being capable of accommodating the sheet;

a plurality of rollers that feed the sheet from the plurality of sheet supply trays, respectively; and a plurality of roller driving units that drive the plurality of rollers; and the controller selects one of the plurality of roller driving units based on the number of printings at each of the plurality of printing portions to drive corresponding one of the plurality of rollers, thereby switching the sheet supply portion.

12. The inkjet printer according to claim 4, wherein the sheet supply unit includes:

a sheet supply tray movable among the plurality of sheet supply portions, the sheet supply tray being capable of accommodating the sheet; and a tray driving unit that moves the sheet supply tray among the plurality of sheet supply portions; and the controller instructs the tray driving unit to move the sheet supply tray to one of the plurality of sheet supply portions based on the number of printings at each of the plurality of printing portions, thereby switching the sheet supply portion.

13. The inkjet printer according to claim 4, further comprising:

a print number storing unit that stores a value equal to the number of sheets printed at each of the plurality of printing portions;

wherein the controller subtracts a first value from a second value stored in the print number storing unit, the second value being the number of sheets printed at a current one of the plurality of printing portions, the first value being the number of sheets printed at another one of the plurality of printing positions, and the controller switches the sheet supply position if the subtracted value is greater than or equal to a prescribed number.

14. The inkjet printer according to claim 4, further comprising a timer that measures an elapsed time period since power supply to the inkjet printer starts for printing at one of the plurality of printing portions, the timer being reset in response to switching the plurality of printing portions, wherein the controller switches the one of the plurality of sheet supply portions to another of the plurality of sheet supply portions when the elapsed time period exceeds or equals a prescribed time period.

15. The inkjet printer according to claim 4, wherein the inkjet head comprises in each of the printing portions: a plurality of nozzles that eject ink; a plurality of pressure chambers in fluid communication with the plurality of nozzles; a piezoelectric sheet provided across the plurality of pressure chambers; a plurality of electrodes provided on the piezoelectric sheet in a one-to-one correspondence with the plurality of pressure chambers, the plurality of electrodes receiving a drive signal for ejecting ink through corresponding one of the plurality of nozzles, the inkjet printer further comprises a storing unit that stores a value equal to the number of timings to apply a drive signal to at least one of plurality of electrodes in each of the plurality of printing portions, and the controller subtracts a first value from a second value stored in the storing unit, the second value being the number of timings to apply a drive signal to at least one of plurality of electrodes in a current one of the plurality of printing portions, the first value being the number of timings to apply a drive signal to at least one of plurality of electrodes in another of the plurality of printing portions, the controller switches a current one of the sheet supply portions to another when the subtracted value is greater than or equal to a prescribed value.

16. The inkjet printer according to claim 15, wherein the storing unit stores a value equal to the number of timings to apply the drive signal to the at least one of the plurality of electrodes representing one of the printing portions.

17. The inkjet printer according to claim 4, further comprising a counter that counts the sheet printed at one of the plurality of printing portions since the one of the plurality of printing portions starts printing, wherein the controller switches the one of the plurality of sheet supply portions to another of the plurality of sheet supply portions when a value of the counted sheets by the counter exceeds or equals a prescribed value.

18. The inkjet printer according to claim 4, further comprising a timer that measures an elapsed time period since power supply to the inkjet printer starts for printing at each of the plurality of printing portions, wherein the controller subtracts a first elapsed time period from a second elapsed time period, the second elapsed time period being for a current one of the plurality of printing portions, the first elapsed time period being for another of the plurality of printing portions, the controller switches a current one of the plurality of sheet supply portions to another of the plurality of sheet supply portions if the subtracted time period is greater than or equal to a prescribed time period.

19. The inkjet printer according to claim 4, wherein the inkjet head comprises in each of the printing portions: a plurality of nozzles that eject ink; a plurality of pressure chambers in fluid communication with the plurality of nozzles; a piezoelectric sheet provided across the plurality of pressure chambers; a plurality of electrodes provided on the piezoelectric sheet in a one-to-one correspondence with the plurality of pressure chambers, the plurality of electrodes receiving a drive signal for ejecting ink through corresponding one of the plurality of nozzles, the inkjet printer further comprises a counter that counts a timing to apply a drive signal to at least one of plurality of electrodes in one of the plurality of printing portions after the one of the plurality of printing portions starts printing, the controller switches the one of the plurality of sheet supply portions to another of the plurality of sheet supply portions when a value of the counted timings by the counter exceeds or equal to a prescribed value.

20. An inkjet printer comprising:

an inkjet head that prints on a sheet, the inkjet head having a plurality of printing portions, the plurality of printing portions being shifted from each other in a width direction crossing a feeding direction of the sheet;

a sheet supply unit having a plurality of sheet supply portions corresponding to the plurality of printing portions, respectively, the sheet supply unit selectively feeding a narrow sheet from one of the plurality of sheet supply portions to a corresponding one of the plurality of printing portions; and a notice signal generating unit that generates a notice signal based on the number of printings at each of the plurality of printing portions, the notice signal indicating that the one of the plurality of sheet supply portions should be switched to another of the plurality of sheet supply portions.

21. The inkjet printer according to claim 20, further comprising:

a detecting unit that detects that a user commands a switching operation of the plurality of sheet supply portions; and a controller that switches the one of the plurality of sheet supply positions to the another in response to an output of the detecting unit.

* * * * *